US007377238B2

(12) United States Patent
Ishikawa et al.

(10) Patent No.: US 7,377,238 B2
(45) Date of Patent: May 27, 2008

(54) VARIABLE COMPRESSION RATIO DEVICE OF INTERNAL COMBUSTION ENGINE

(75) Inventors: Seiichiro Ishikawa, Wako (JP); Takashi Kondo, Wako (JP); Kazuo Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/645,493

(22) Filed: Dec. 27, 2006

(65) Prior Publication Data

US 2007/0175420 A1 Aug. 2, 2007

(30) Foreign Application Priority Data

Dec. 28, 2005 (JP) ..... 2005-379083

(51) Int. Cl.
*F01B 13/04* (2006.01)
*F02B 57/00* (2006.01)

(52) U.S. Cl. ..... 123/43 R; 123/48 R; 123/56.4; 123/78 R; 91/505; 92/82

(58) Field of Classification Search ..... 123/48 R, 123/48, 56.4, 78 R, 48 B; 91/505; 92/82; *F01B 13/04; F02B 57/00, 75/26*
See application file for complete search history.

(56) References Cited

U.S. PATENT DOCUMENTS 2,376,214 A * 5/1945 Webster ..... 123/78 R
3,156,162 A * 11/1964 Wallace et al. ..... 92/82
5,476,074 A * 12/1995 Boggs et al. ..... 123/48 B
7,066,118 B2 * 6/2006 Hirano ..... 123/48 B
2004/0231619 A1 * 11/2004 Hirano ..... 123/48 B

FOREIGN PATENT DOCUMENTS

JP 2004-44512 A 2/2004

* cited by examiner

*Primary Examiner*—Stephen K. Cronin
*Assistant Examiner*—Keith Coleman
(74) *Attorney, Agent, or Firm*—Birch, Stewart, Kolasch & Birch LLP

(57) ABSTRACT

A variable compression ratio device of an internal combustion engine includes a piston inner part connected to a connecting rod and a piston outer part fitted on an outer periphery of the piston inner part. The piston outer part is only slidably in an axial direction, and is movable between a low compression ratio position near the piston inner part and a high compression ratio position near the combustion chamber. A skirt part is slidable and is guided by an inner peripheral surface of a cylinder bore of an engine. The skirt part is integrally formed on the piston inner part. A peripheral wall of the piston outer part is terminated directly above the skirt part. Thus, switching of the position between the low compression ratio position and the high compression ratio position by an inertia force of the piston outer part is performed smoothly with a reduction in weight of the piston.

22 Claims, 20 Drawing Sheets

LOW COMPRESSION RATIO

LOW COMPRESSION RATIO

LOW COMPRESSION RATIO

LOW COMPRESSION RATIO

HIGH COMPRESSION RATIO

HIGH COMPRESSION RATIO

HIGH COMPRESSION RATIO

HIGH COMPRESSION RATIO

LOW COMPRESSION RATIO

HIGH COMPRESSION RATIO

LOW COMPRESSION RATIO

HIGH COMPRESSION RATIO

HIGH COMPRESSION RATIO

HIGH COMPRESSION RATIO

VARIABLE COMPRESSION RATIO DEVICE OF INTERNAL COMBUSTION ENGINE

CROSS-REFERENCE TO RELATED APPLICATION

The present application claims priority under 35 USC 119 to Japanese Patent Application No. 2005-379083 filed on Dec. 28, 2005 the entire contents of which are hereby incorporated by reference.

BACKGROUND OF THE INVENTION

1. Field of the Invention

The present invention relates to an improvement of a variable compression ratio device of an internal combustion engine, wherein a piston includes a piston inner part which is connected to a connecting rod via a piston pin and a piston outer part which is fitted on an outer periphery of the piston inner part so as to be only slidable in an axial direction. The piston outer part is movable between a low compression ratio position near the piston inner part and a high compression ratio position near a combustion chamber, with an outer end surface of the piston outer part facing the combustion chamber. A cam mechanism is provided between the piston inner part and the piston outer part that alternately gives the low compression ratio position and the high compression ratio position to the piston outer part. An actuator is provided in the piston inner part to operate the cam mechanism. The cam mechanism includes a lift member which is supported by the piston inner part and is moved by the actuator alternately to a lift release position and a lift position. A plurality of first cam top portions are projectingly provided integrally on a top surface of the lift member. A plurality of second cam top portions are projectingly provided on an undersurface of a head part of the piston outer part. In the lift release position of the lift member, the first cam top portions and the second cam top portions are meshed with each other to move the piston outer part to the low compression ratio position. In the lift position of the lift member, the first cam top portions and the second cam top portions cause their top surfaces to abut on each other to move the piston outer part to the high compression ratio position.

2. Description of the Related Art

Japanese Patent Application Laid-open No. 2004-44512 discloses a variable compression ratio device for an internal combustion engine.

In the conventional variable compression ratio device of an internal combustion engine, a cam mechanism moves a piston outer part alternately to a low compression ratio position and a high compression ratio position. The cam mechanism includes a lift member which is supported by a piston inner part to move between a lift release position and a lift position. A plurality of first cam top portions are projectingly provided integrally on a top surface of the lift member. A plurality of second cam top portions are projectingly provided on an undersurface of a head part of the piston outer part. In the lift release position of the lift member, the first cam top portions and the second cam top portions are meshed with each other to move the piston outer part to a low compression ratio position. In the lift position of the lift member, the first cam top portions and the second cam top portions cause their top surfaces to abut on one another to move the piston outer part to a high compression ratio position. Therefore, in either of the low compression ratio position and the high compression ratio position of the piston outer part, the piston inner part and the piston outer part abut on each other in a large area via the cam mechanism, so that heat transfer from the piston outer part at a high temperature to the piston inner part at a low temperature is excellently performed. Thus, the variable compression ratio device has an advantage of being capable of enhancing a cooling performance of the piston.

However, since a skirt part which is slidably fitted to an inner peripheral surface of a cylinder bore to stabilize the posture of the piston is formed at the piston outer part, when the piston outer part switches the position between the low compression ratio position and the high compression ratio position by using its inertia force, the piston outer part is slid accompanying the skirt part on the inner peripheral surface of the cylinder bore, so that a delay in switching of the position sometimes occurs due to sliding resistance of the skirt part. In addition, since the piston inner part is slidably fitted to the inner peripheral surface of the piston outer part over its entire outer peripheral surface, the fitting area of the piston inner part and the piston outer part is large, thereby increasing the weight of the piston.

SUMMARY OF THE INVENTION

The present invention has been achieved in view of the above circumstances. An object of an embodiment of the present invention is to provide a variable compression ratio device of an internal combustion engine capable of performing smooth switching of the position between a low compression ratio position and a high compression ratio position by an inertia force of a piston outer part, and reducing the weight of a piston while making use of the original advantage.

In order to achieve the above object, according to an embodiment of the present invention, there is provided a variable compression ratio device of an internal combustion engine wherein a piston includes a piston inner part which is connected to a connecting rod via a piston pin and a piston outer part which is fitted on an outer periphery of the piston inner part so as to be only slidable in an axial direction. The piston outer part is movable between a low compression ratio position near the piston inner part and a high compression ratio position near a combustion chamber, with an outer end surface of the piston outer part facing the combustion chamber. A cam mechanism is provided between the piston inner part and the piston outer part that alternately gives the low compression ratio position and the high compression ratio position to the piston outer part. An actuator is provided in the piston inner part to operate the cam mechanism. The cam mechanism includes a lift member which is supported by the piston inner part and is moved by the actuator alternately to a lift release position and a lift position. A plurality of first cam top portions are projectingly provided integrally on a top surface of the lift member. A plurality of second cam top portions are projectingly provided on an undersurface of a head part of the piston outer part. In the lift release position of the lift member, the first cam top portions and the second cam top portions are meshed with each other to move the piston outer part to the low compression ratio position. In the lift position of the lift member, the first cam top portions and the second cam top portions cause their top surfaces to abut on each other to move the piston outer part to the high compression ratio position. A skirt part is slidable and is guided by an inner peripheral surface of a cylinder bore of an engine. The skirt part is integrally formed at the piston inner part. A peripheral wall of the piston outer part, to which piston rings are fitted, is terminated directly above the skirt part.

The actuator corresponds to a first actuator $45_1$ in embodiments of the present invention which will be described later.

With the first embodiment of the present invention, in either of the low compression ratio position and the high compression ratio position of the piston outer part, the piston inner part and the piston outer part abut on each other in a large area via the cam mechanism. Therefore, heat transfer from the piston outer part at a high temperature to the piston inner part at a low temperature is smooth, and excellent cooling performance of the piston can be ensured.

In addition, while the skirt part, whose sliding is guided by the inner peripheral surface of the cylinder bore of the engine, is integrally formed on the piston inner part, the peripheral wall of the piston outer part, to which the piston rings are fitted, is terminated directly above the skirt part, that is, the piston outer part does not have the skirt part. Thus, even when the piston outer part switches the position between the low compression ratio position and the high compression ratio position by using its inertia force, the piston outer part can perform a switching of the positions smoothly without interference by frictional resistance between the skirt part and the inner peripheral surface of the cylinder bore.

Forming the skirt part at the piston inner part greatly reduces the overlapping portions of the piston inner part and the piston outer part, and thus greatly reduces the weight of the piston, thereby contributing to an enhancement in output performance and durability of the engine.

According to a second embodiment of the present invention, the lift member is formed into an annular shape to rotate between the lift release position and the lift position around a pivotal shaft which is formed coaxially integrally with the piston inner part. The plurality of first cam top portions and second cam top portions are respectively disposed in annular shapes coaxially with the pivotal shaft.

With the second embodiment of the present invention, the cam mechanism is disposed annularly between the piston inner part and the piston outer part, thereby allowing the piston inner part and the piston outer part to abut on each other over their entire peripheries via the cam mechanism. Therefore, transmission of a thrust force and heat between the piston inner part and the piston outer part can be always excellently performed in either of the low compression ratio position and the high compression ratio position of the piston outer part, thus contributing to an enhancement in durability of the piston.

According to a third embodiment of the present invention, the skirt part of the piston inner part is formed into a pair of arc-shapes except for portions corresponding to opposite ends of the piston pin. A pair of ear parts opposed to the opposite ends of the piston pin are integrally formed at the piston outer part. A shaft part linked to the opposite ends of the piston pin is slidably fitted in long holes which are formed in the ear parts and which have long diameters facing in an axial direction of the piston, thereby inhibiting relative rotation between the piston inner part and the piston outer part.

With the third embodiment of the present invention, without interference by the skirt part of the piston inner part, relative rotation between the piston inner part and the piston outer part can be easily inhibited by using the ear parts of the piston outer part which are disposed to be opposed to the piston pin and the shaft part which is linked to the opposite ends of the piston pin.

According to a fourth embodiment of the present invention, an opening for introducing lubricating oil which is scattered in a crankcase into the cam mechanism is provided in a central portion of the piston inner part.

With the fourth embodiment of the present invention, the cam mechanism can be lubricated by the lubricating oil scattered in the crankcase.

According to a fifth embodiment of the present invention, the actuator is constructed to be of a hydraulic type using the lubricating oil of the engine as operating oil. The cam mechanism is lubricated with the operating oil leaking from the actuator.

With the fifth embodiment of the present invention, the cam mechanism can be effectively lubricated by using the operating oil leaking from the actuator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
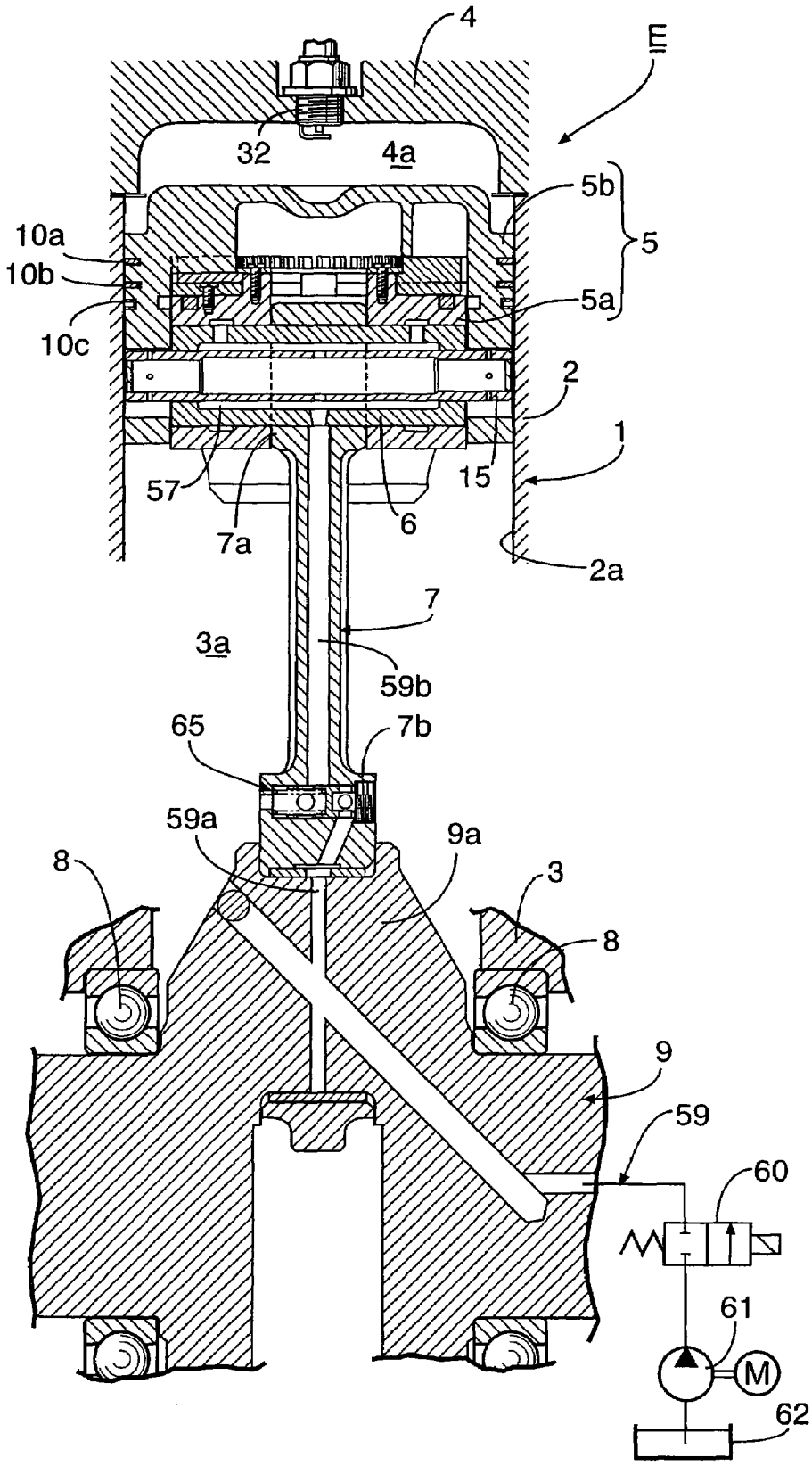
FIG. 1 is a vertical sectional front view of a main part of an internal combustion engine including a variable compression ratio device according to a first embodiment of the present invention.

A first embodiment of the present invention will be described with reference to FIGS. 1 to 18. In FIGS. 1 and 5, an engine body 1 of an internal combustion engine E includes a cylinder block 2 having a cylinder bore 2*a*, a crankcase 3 which is connected to a lower end of the cylinder block 2 and a cylinder head 4 which has a pent roof type combustion chamber 4*a* connected to an upper end of the cylinder bore 2*a* and which is connected to an upper end of the cylinder block 2. Threadedly fitted to the cylinder head 4 are an intake valve 31*i* and an exhaust valve 31*e* that open and close an intake port 30*i* and an exhaust port 30*e* which are opened in a ceiling surface of the combustion chamber 4*a*, and an ignition plug 32 with electrodes facing a central portion of the combustion chamber 4*a*.

A small end portion 7*a* of a connecting rod 7 is connected via a piston pin 6 to a piston 5 which is slidably fitted in the cylinder bore 2*a*. A large end portion 7*b* of the connecting rod 7 is connected via a pair of left and right bearings 8 to a crank pin 9*a* of a crankshaft 9 which is rotatably supported in the crankcase 3.

As shown in FIGS. 2 to 5, the piston 5 includes a piston inner part 5*a* which is connected to the small end portion 7*a* of the connecting rod 7 via the piston pin 6 and a piston outer 5*b* which is slidably fitted to an outer peripheral surface of the piston inner part 5*a* and has its top surface facing the combustion chamber 4*a*. A plurality of piston rings 10*a* to 10*c* are attached to an outer periphery of the piston outer part 5*b* so as to be slidable in close contact with an inner peripheral surface of the cylinder boar 2*a*.

A pair of pin boss parts 11 and a pair of arc-shaped skirt parts 12 are integrally formed at the piston inner part 5*a*. The pin boss parts 11 support opposite end portions of the piston pin 6. The skirt parts 12 are slidably fitted to the inner peripheral surface of the cylinder bore 2*a* except for the portions corresponding to outer ends of the pin boss parts 11. The piston pin 6 is formed to be hollow.

In the piston outer part 5*b*, a peripheral wall to which the piston rings 10*a* to 10*c* are fitted is terminated at the positions opposed to the upper end surfaces 12*a* of the skirt parts 12. A pair of ear parts 13 opposed to the outer ends of both the pin boss parts 11 are integrally formed at the piston outer part 5*b*. The ear parts 13 are provided with long holes 14 having longer diameters in the axial direction of the piston 5. An extension shaft 15 penetrates through the hollow part of the piston pin 6, with its opposite end portion being fitted into the long holes 14 to be slidable in the axial direction of the piston 5, and is fixed to the piston pin 6 by press-fitting or the like. Thus, the fitting between the long holes 14 and the extension shaft 15 allows relative sliding therebetween in the axial direction while inhibiting relative rotation therebetween. The extension shaft 15 abutting on the lower surfaces of the long holes 14 defines the downward slide limit of the piston inner part 5*a* with respect to the piston outer part 5*b*.

A pair of inner slide flat surfaces 23 extending in the axial direction of the piston pin 5 are formed at opposite side portions, facing the opposite end surfaces of the piston pin 6, of the outer peripheral surface of the piston inner part 5*a*. Outer slide flat surfaces 24 which slidably abut on the inner slide flat surface 23 are formed on inner surfaces of the ear parts 13 of the piston outer part 5*b*. These slide flat surfaces 23 and 24 also allow for relative sliding in the axial direction between the piston inner part 5*a* and the piston outer part 5*b* while inhibiting the relative rotation therebetween. Accordingly, the relative rotation between the piston inner part 5*a* and the piston outer part 5*b* can be firmly inhibited by the fitting between the long holes 14 and the extension shaft 15 and the abutment between the inner and outer slide flat surfaces 23 and 24. Use of both the fitting structure between the long holes 14 and the extension shaft 15 and the abutment structure between the inner and outer slide flat surfaces 23 and 24 for prevention of the relative rotation of the piston inner part 5*a* and the piston outer part 5*b* reduces the load acting on each structure, thereby effectively enhancing frictional resistance and rigidity for the prevention of rotation of the piston inner part 5*a* and the piston outer part 5*b*. However, depending on the required specifications, only one of these structures can be used.

Figure 2:
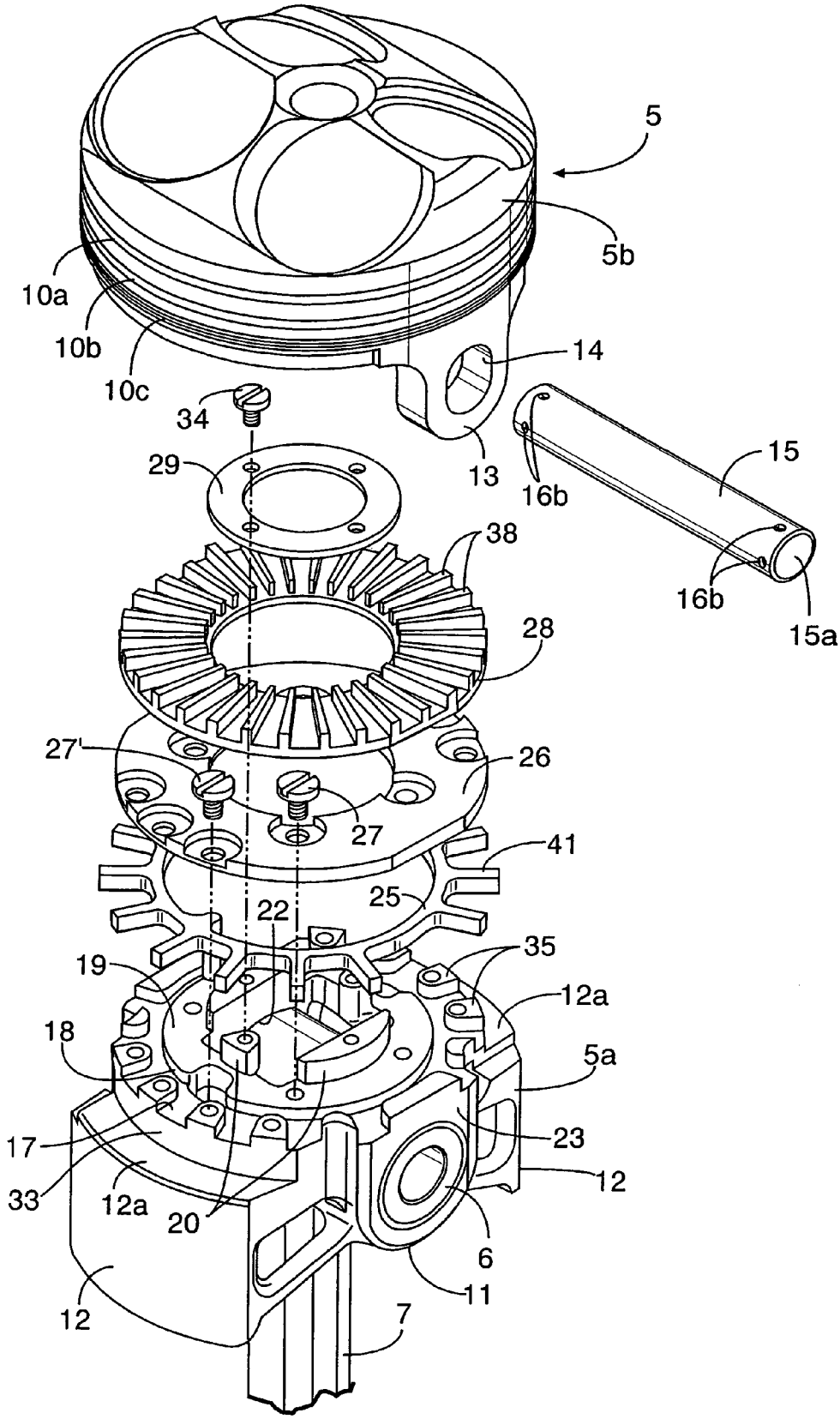
FIG. 2 is an exploded perspective view taken from above the variable compression ratio device.
Figure 3:
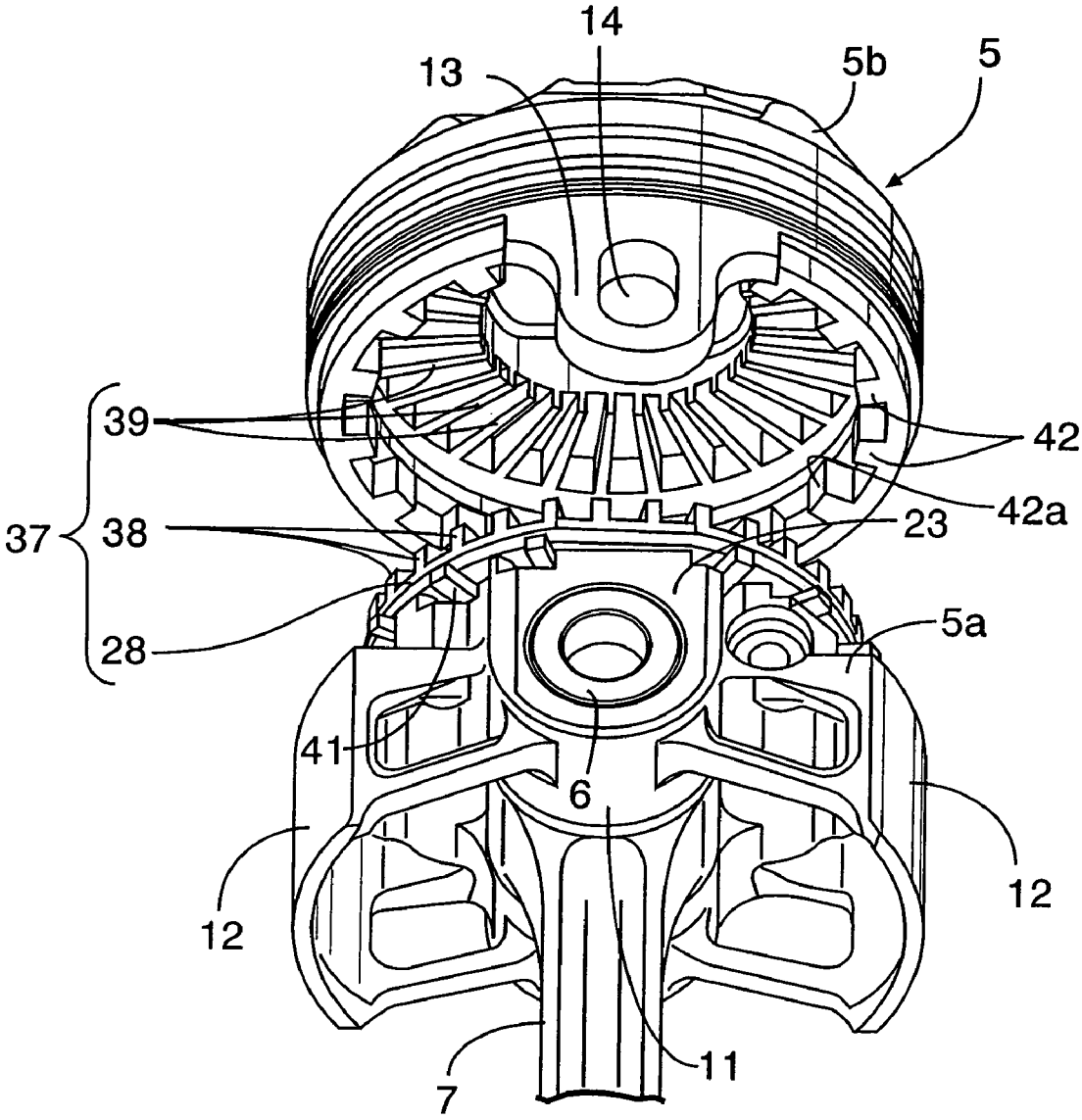
FIG. 3 is an exploded perspective view taken from below the variable compression ratio device.

In FIGS. 2, 3 and 5, the piston inner part 5*a* and the piston outer part 5*b* obtain a sufficient relative slide support length in the axial direction by virtue of the slidable fitting between the extension shaft 15 and the long holes 14 and slidable fitting between a pair of arc surfaces 33 on the outer periphery of the piston inner part 5*a* and an inner peripheral surface 42*a* of a female spline 42 of the piston outer part 5*b*, thereby securing stable relative slide in the axial direction. The arc surfaces 33 are vertically formed to connect upper end surfaces 12*a* of a pair of skirt parts 12 and first support surfaces 17.

Figure 4:
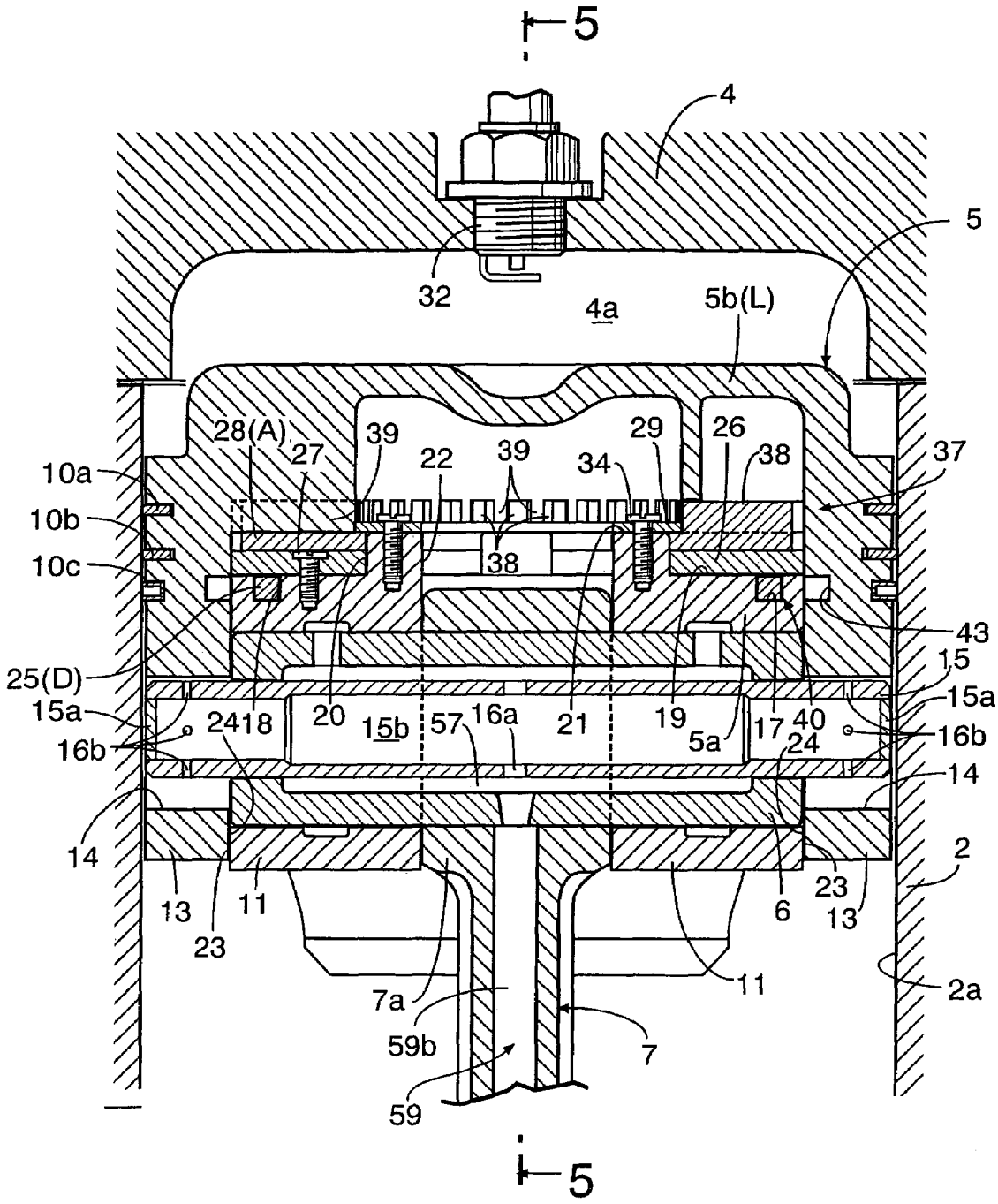
FIG. 4 is an enlarged view of the main part (low compression ratio state) in FIG. 1.
Figure 5:
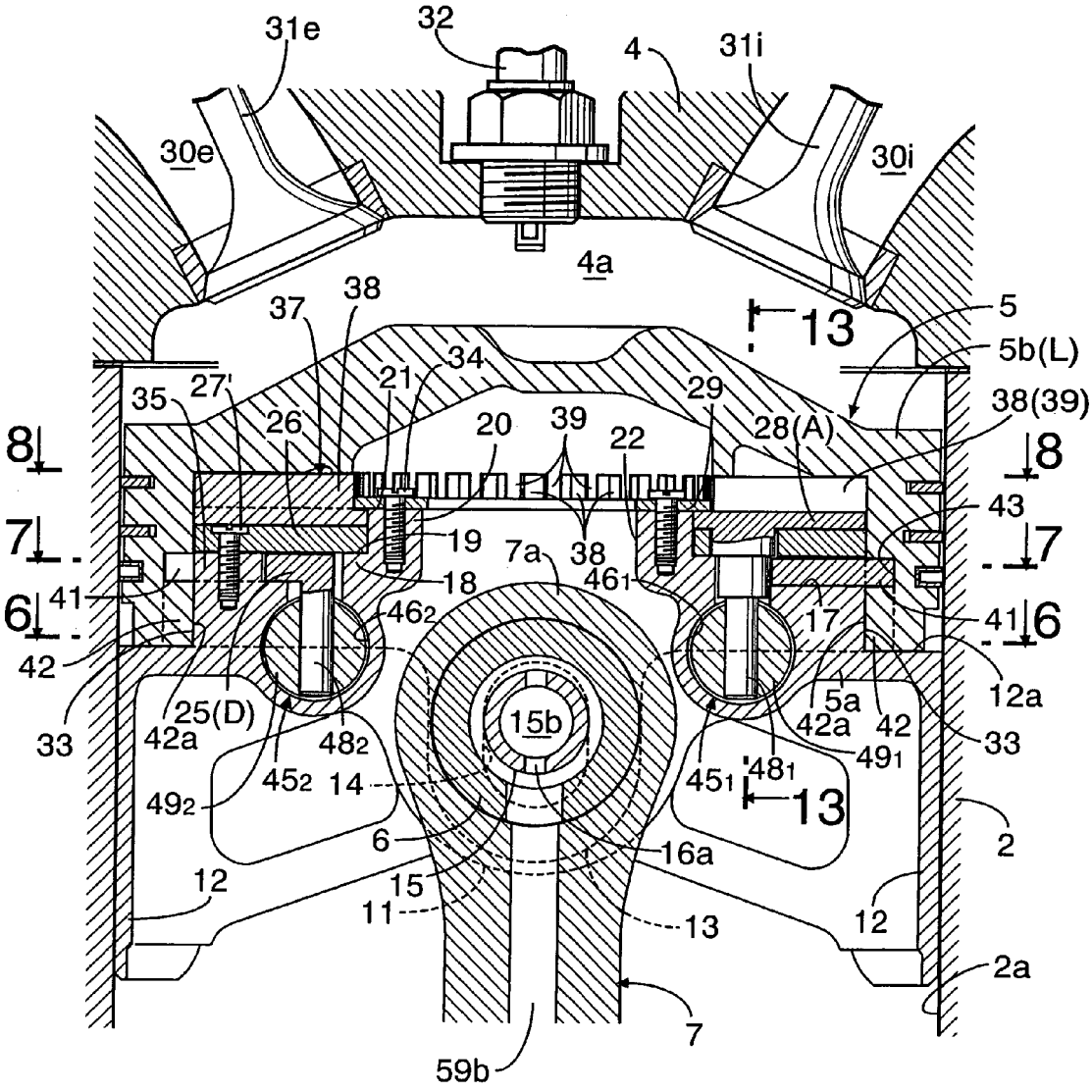
FIG. 5 is a sectional view taken on line 5-5 in FIG. 4.

As clearly shown in FIGS. 3 to 5, a circular first support surface 17 facing up, a first pivotal shaft 18 rising from an inner peripheral edge of the first support surface 17, a circular second support surface 19 which is formed at an upper end of the first pivotal shaft 18, a second pivotal shaft 20 rising from an inner peripheral edge of the second support surface 19, and a circular third support surface 21 which is formed at an upper end surface of the second pivotal shaft 20 are formed at the upper portion of the piston inner part 5*a* coaxially with the piston inner part 5*a* and sequentially from its outer peripheral side. The second pivotal shaft 20 is divided into a plurality of blocks along its circumferential direction in order to reduce its weight. An opening 22 facing the small end portion 7*a* of the connecting rod 7 is provided in a central portion of the second pivotal shaft 20. Scattered lubricating oil generated in the crankcase 3, that is, the crank chamber 3*a* passes through the opening 22.

An annular lock plate 25 which is mounted on the first support surface 17 is rotatably fitted on the first pivotal shaft 18. An annular first holding plate 26 which is fitted on the second pivotal shaft 20 to be opposed to the top surface of the lock plate 25 is fixed to the second support surface 19 with a plurality of screws 27. An annular lift member 28 which is mounted on the first holding plate 26 is rotatably fitted on the second pivotal shaft 20. A second holding plate 29 opposed to the top surface of an inner peripheral edge portion of the lift member 28 is fixed to the third support surface 21 with a plurality of screws 34.

The lift member 28 is capable of reciprocally rotating between a lift position B and a lift release position A which are set around the second pivotal shaft 20. The lift member 28 forms a main part of a cam mechanism 37 which alternately holds the piston outer part 5*b* in a low compression ratio position L (see FIGS. 4 and 5) near the piston inner part 5*a* and in a high compression ratio position H (see FIGS. 9 and 10) near the combustion chamber 4*a*, with its reciprocal rotation.

Figure 8:
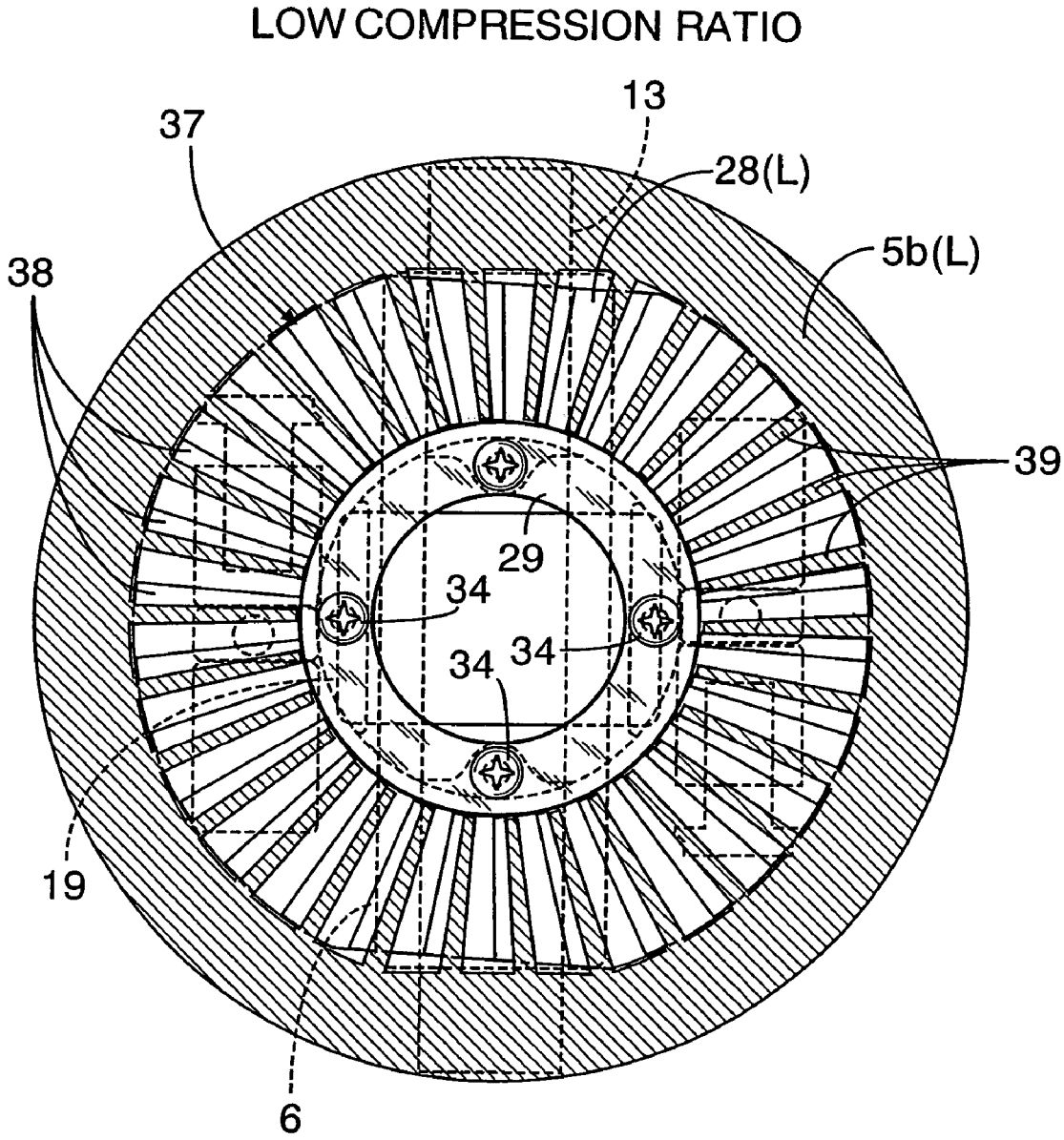
FIG. 8 is a sectional view taken on line 8-8 in FIG. 5.

More specifically, as shown in FIGS. 4, 5 and 8, the cam mechanism 37 includes the lift member 28, a plurality of first cam top portions 38 in a circular arrangement which are integrally projectingly provided on a top surface of the lift member 28 and second cam top portions 39 in a circular arrangement which are projectingly provided on an undersurface of a head part of the piston outer part 5*b*. In each of the cam top portions 38 and 39, its top surface is flat and opposite side surfaces, which are arranged in an arranging direction of each of the cam top portions 38 and 39, are formed to be rectangular in section that are vertical surfaces with respect to its top surface.

Thus, when the lift member 28 is in the lift release position A, the upper second cam top portions 39 are capable of entering and leaving bottom portions between the first cam top portions 38 of the member 28 (see FIG. 13), thereby allowing a shift of the piston outer part 5*b* to the low compression ratio position L or the high compression ratio position H. When the first and the second cam top portions 38 and 39 are meshed with each other, and the top surface of at least one of the cam top portions abuts on the bottom of the bottom portion between the other cam top portions, the cam mechanism 37 enters the axially contracted state to bring the piston outer part 5*b* into the low compression ratio position L.

When the lift member 28 is in the lift position B, the flat top surfaces of the first and the second cam top portions 38 and 39 abut against each other (see FIG. 14) so that the cam mechanism 37 enters the axially extended state, thereby bringing the piston outer part 5*b* into the high compression ratio position H. At this time, the extension shaft 15 which is fixed to the piston pin 6 as described above abuts on the lower surfaces of the long holes 14 of the ear parts 13 in the piston outer part 5*b*, thereby preventing the piston outer part 5*b* from exceeding the predetermined high compression ratio position H to move to the combustion chamber 4*a* side.

Figure 7:
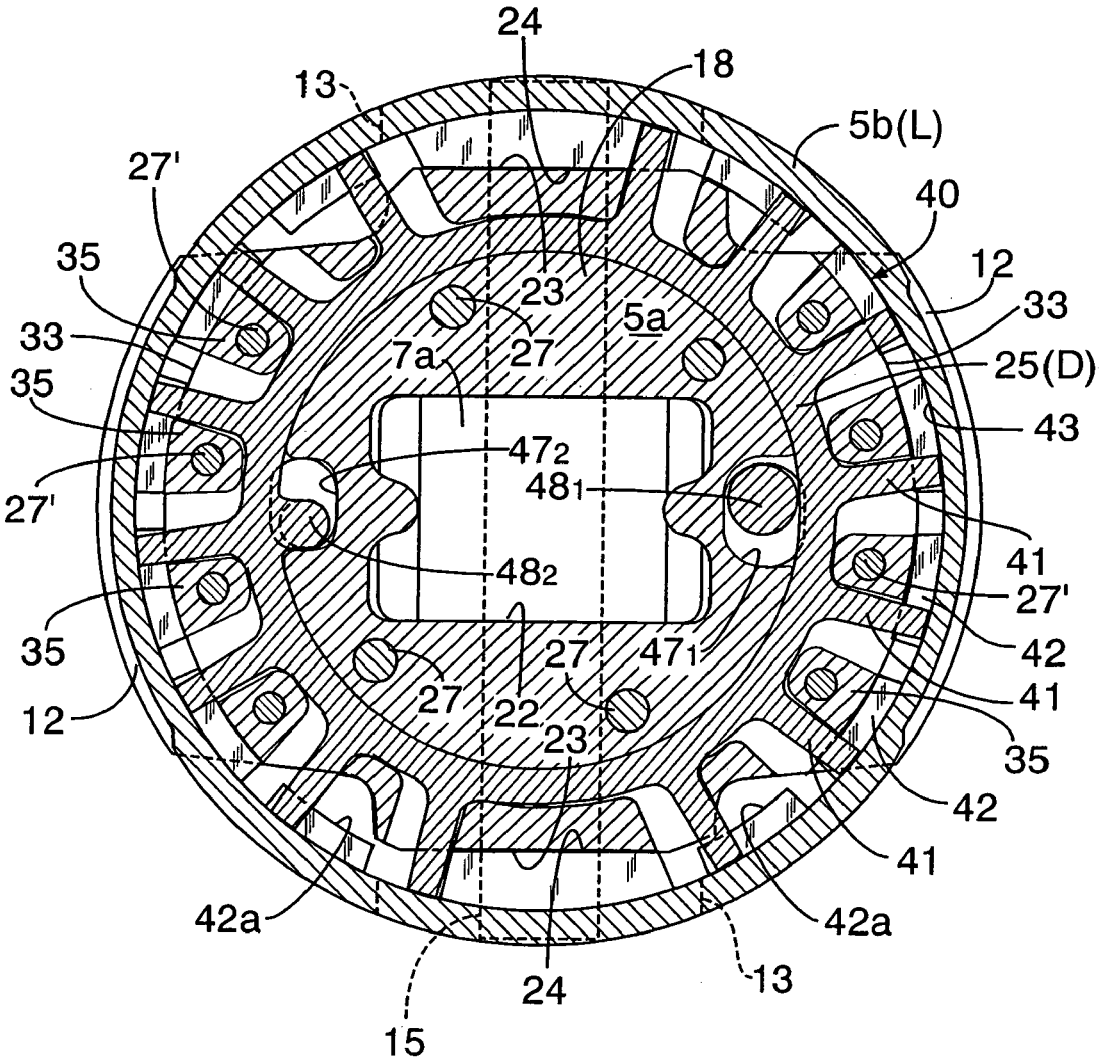
FIG. 7 is a sectional view taken on line 7-7 in FIG. 5.

As shown in FIGS. 4, 5 and 7, the lock plate 25 is capable of reciprocally rotating between a lock release position C (see FIG. 12) and a lock position D (see FIG. 7) which are set around the first pivotal shaft 18. The lock plate 25 forms a main part of a lock mechanism 40 which maintains the axially contracted state of the cam mechanism 37 in its lock position D.

More specifically, the lock mechanism 40 comprises: the lock plate 25, a male spline 41 which is formed on an outer periphery of the lock plate 25, the female spline 42 which is formed on an inner periphery of the piston outer part 5*b* for the male spline 41 to be slidably fitted therein and an annular lock groove 43 which provides communication between upper end portions of groove portions of the female spline 42 to allow rotation and entry of tooth portions of the male spline 41. When switching the position of the piston outer part 5*b* between the low compression ratio position L and the high compression ratio position H, the lock mechanism 40 sets the lock plate 25 at the lock release position C to bring the male spline 41 in sliding relationship with the female spline 42. When the piston outer part 5*b* comes to the low compression ratio position L, the lock mechanism 40 rotates the lock plate 25 to the lock position D to allow the tooth portion of the male spline 41 to enter the lock groove 43 so that the end surfaces of the tooth portion of the male spline 41 and the tooth portion of the female spline 42 abut against each other, whereby the low compression ratio position L of the piston outer part 5*b* is locked.

Figure 10:
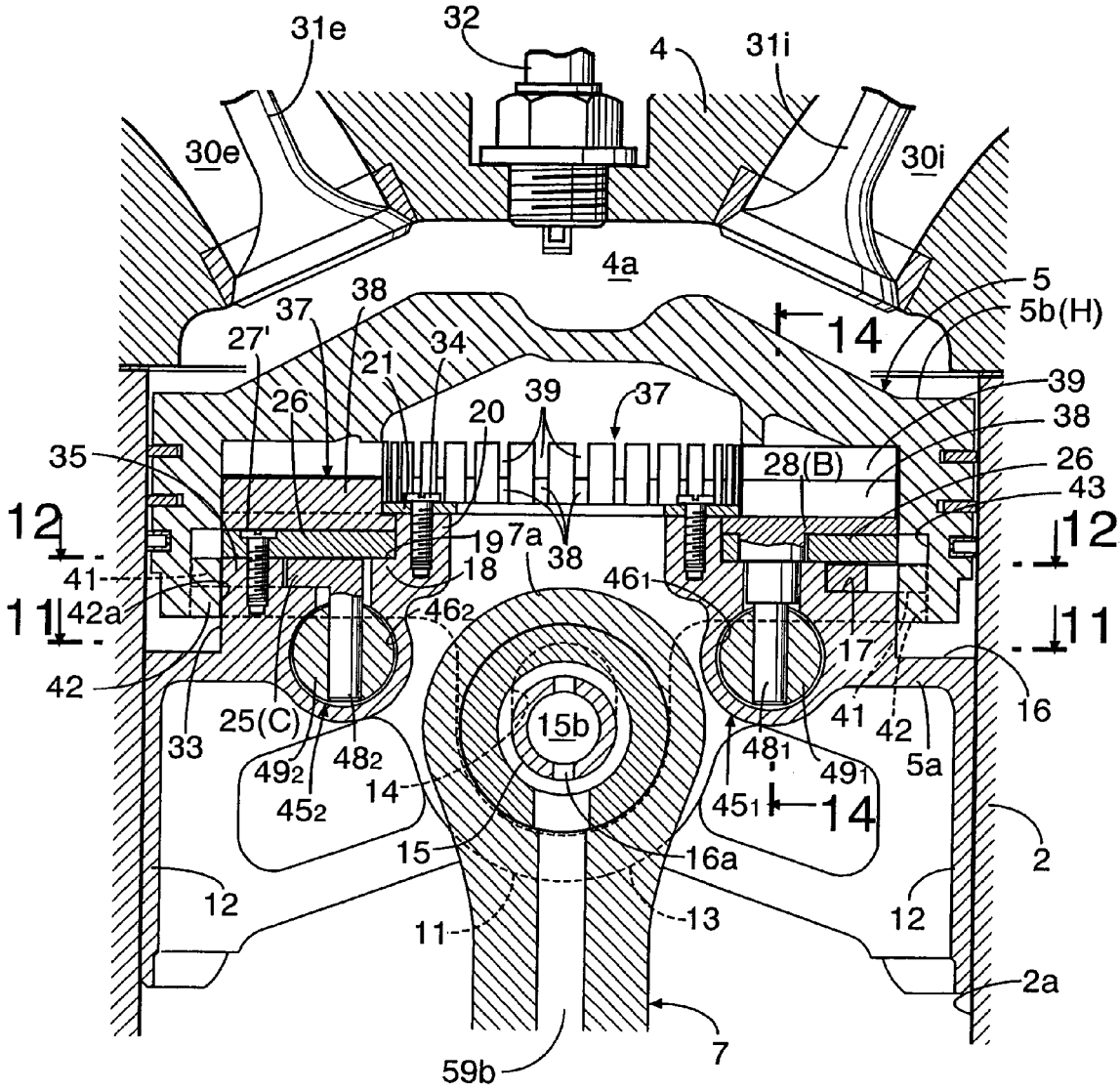
FIG. 10 is a sectional view taken on line 10-10 in FIG. 9.
Figure 11:
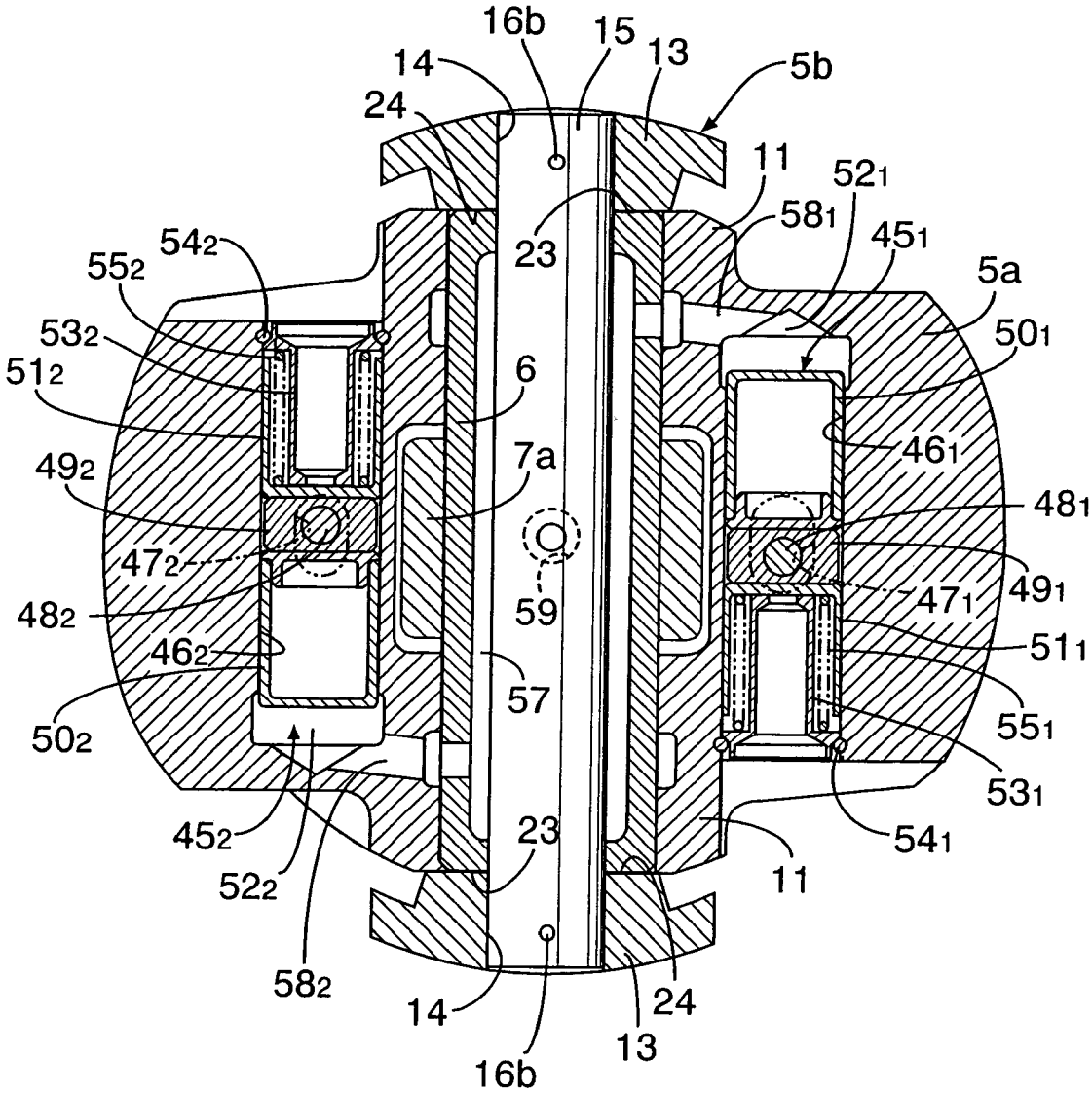
FIG. 11 is a sectional view taken on line 11-11 in FIG. 10.
Figure 12:
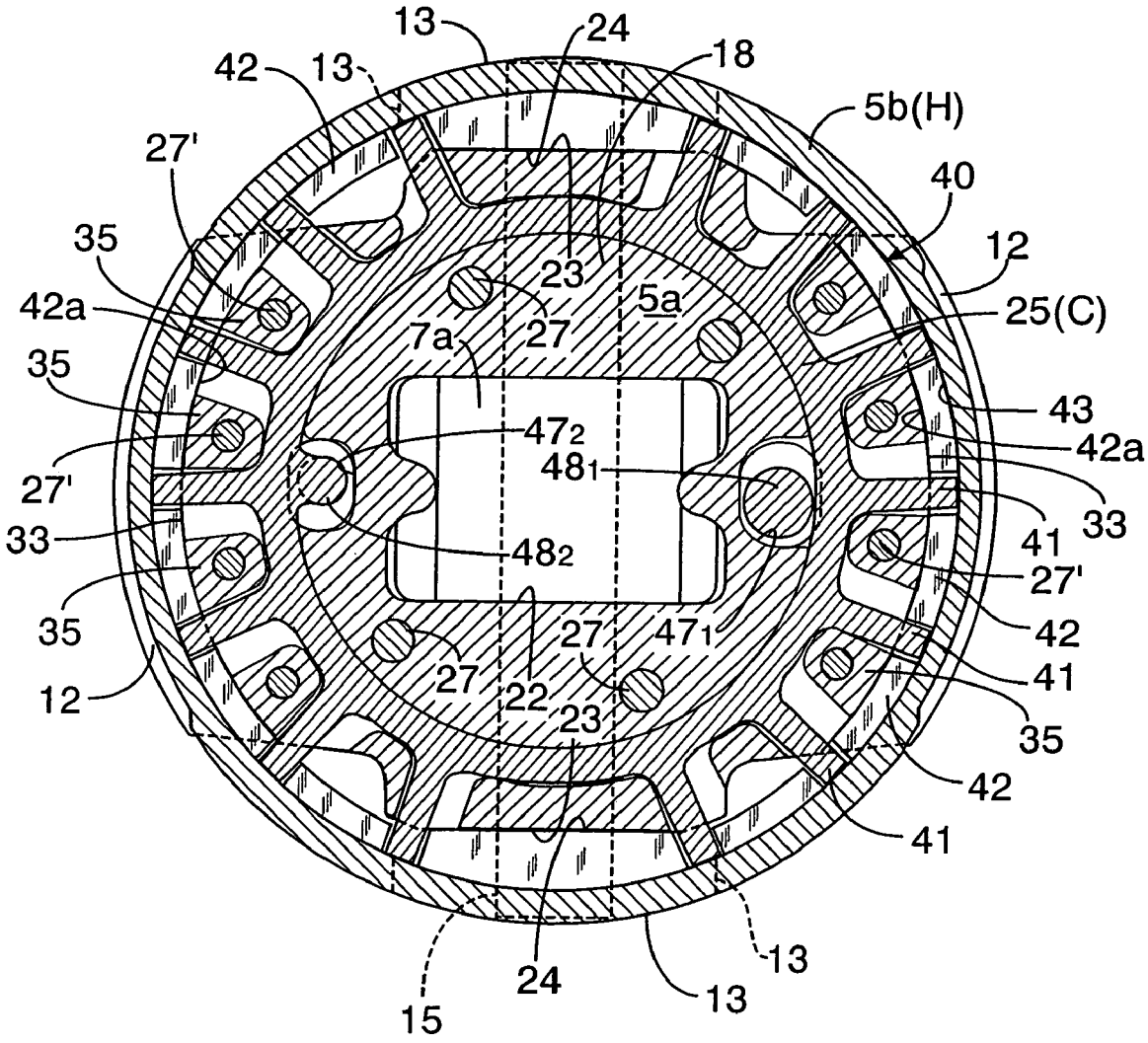
FIG. 12 is a sectional view taken on line 12-12 in FIG. 10.
Figure 13:
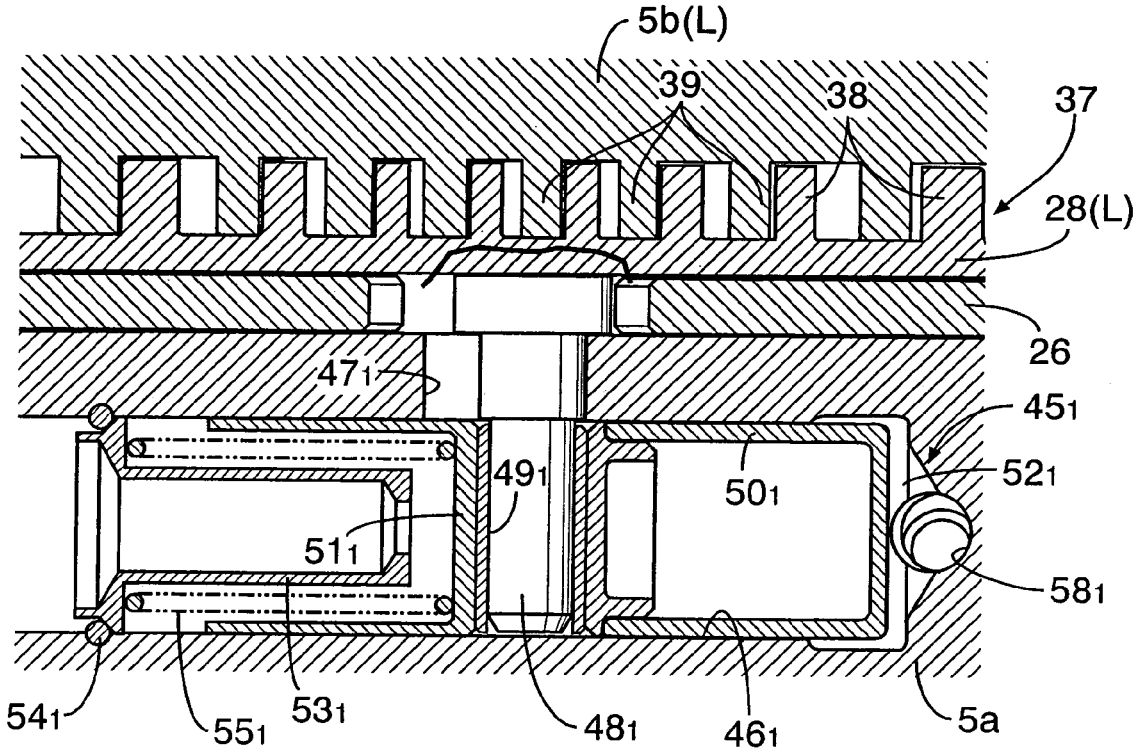
FIG. 13 is a sectional view (low compression ratio state) taken on line 13-13 in FIG. 5.

As shown in FIGS. 2 and 10, in order to reinforce the hold on the lock plate 25 by the first holding plate 26, a plurality of bosses 35 which are disposed in a plurality of groove portions of the male spline 41 to support an undersurface of an outer peripheral portion of the first holding plate 26 are integrally formed on the piston inner part 5*a*. The outer peripheral portion of the first holding plate 26 is fixed to the bosses 35 with a plurality of screws 27'. The bosses 35 are naturally formed so as not to interfere with rotation of the male spline 41 to the lock release position C and the lock position D.

The piston inner part 5*a* is provided with first and second actuators $\mathbf{45}_1$ and $\mathbf{45}_2$ which drive the lift member 28 and the lock plate 25, respectively. They will be described below with reference to FIGS. 5, 6, 13 and 14.

First, the first actuator $\mathbf{45}_1$ will be described. The piston inner part 5*a* is provided with a bottomed cylinder hole $\mathbf{46}_1$ which is provided on one side of the piston pin 6 so as to extend parallel with the piston pin 6, and a long hole $\mathbf{47}_1$ which penetrates through an upper wall of an intermediate portion of the cylinder hole $\mathbf{46}_1$ and the first holding plate 26. A pressure receiving pin $\mathbf{48}_1$ is projectingly provided on the undersurface of the lift member 28 so as to face the cylinder hole $\mathbf{46}_1$ through the long hole $\mathbf{47}_1$.

A disk-shaped slider $\mathbf{49}_1$ which is loosely fitted in the cylinder hole $\mathbf{46}_1$ to be idly movable in a radius direction in the cylinder hole $\mathbf{46}_1$ is mounted to the pressure receiving pin $\mathbf{48}_1$ to be capable of relatively oscillating. In the cylinder hole $\mathbf{46}_1$, an operation plunger $\mathbf{50}_1$ and a bottomed cylindrical return plunger $\mathbf{51}_1$ are slidably fitted with the slider $\mathbf{49}_1$ disposed therebetween. Accordingly, the slider $\mathbf{49}_1$ is interposed between the pressure receiving pin $\mathbf{48}_1$, and the operation plunger $\mathbf{50}_1$ and the return plunger $\mathbf{51}_1$. Circular-arc movement of the pressure receiving pin $\mathbf{48}_1$ around the rotational center of the lift member 28 is allowed by the slider $\mathbf{49}_1$ moving inside the cylinder hole $\mathbf{46}_1$ while sliding between the operation plunger $\mathbf{50}_1$ and the return plunger $\mathbf{51}_1$. In addition, the contact of the respective parts from the pressure receiving pin $\mathbf{48}_1$ to the operation plunger $\mathbf{50}_1$ and the return plunger $\mathbf{51}_1$ is always in contact in a plane, thereby securing abrasion resistance of the contact parts.

A hydraulic chamber $\mathbf{52}_1$ to which an inner end of the operation plunger $\mathbf{50}_1$ is opposed is defined in the cylinder hole $\mathbf{46}_1$. When hydraulic pressure is supplied to the hydraulic chamber $\mathbf{52}_1$, the operation plunger $\mathbf{50}_1$ receives the hydraulic pressure and rotates the lift member 28 to the lift position B via the slider $\mathbf{49}_1$ and the pressure receiving pin $\mathbf{48}_1$, and the long hole $\mathbf{47}_1$ has a size which does not interfere with the movement of the pressure receiving pin $\mathbf{48}_1$ at this time.

A cylindrical spring holding cylinder $\mathbf{53}_1$ is locked at an end portion at an open side of the cylinder hole $\mathbf{46}_1$ via a retaining ring $\mathbf{54}_1$. A return spring $\mathbf{55}_1$ urging the return plunger $\mathbf{51}_1$ toward the pressure receiving pin $\mathbf{48}_1$ is provided under compression between the spring holding cylinder $\mathbf{53}_1$ and the return plunger $\mathbf{51}_1$.

Figure 14:
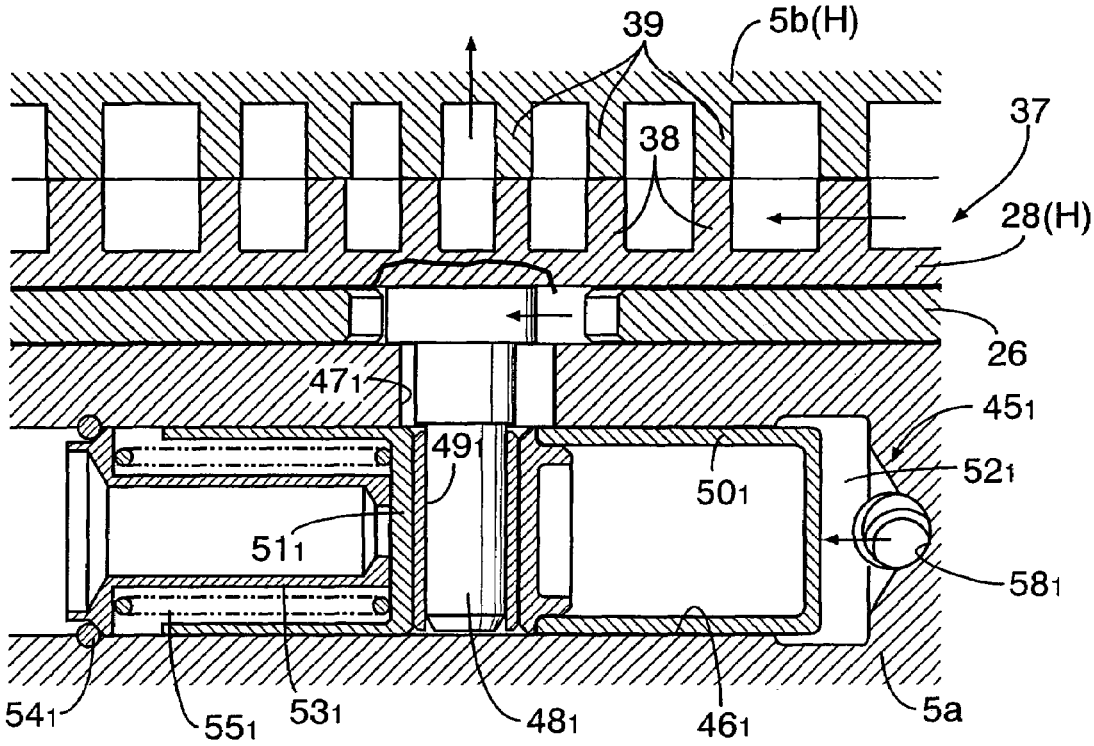
FIG. 14 is a view corresponding to FIG. 13, showing the high compression ratio state.

Thus, the lift release position A of the lift member 28 is defined by the pressure receiving pin $\mathbf{48}_1$ abutting on the inner end wall on the operation plunger $\mathbf{50}_1$ side, of the long hole $\mathbf{47}_1$ (see FIG. 13), and the lift position B of the lift member 28 is defined by the pressure receiving pin $\mathbf{48}_1$ abutting on the spring holding cylinder $\mathbf{53}_1$ via the slider $\mathbf{49}_1$ and the return plunger $\mathbf{51}_1$ (see FIG. 14).

The second actuator $\mathbf{45}_2$ is disposed to be axisymmetric or point-symmetric with the first actuator $\mathbf{45}_1$ with the piston pin 6 disposed therebetween. A pressure receiving pin $\mathbf{48}_2$ is projectingly provided on the undersurface of the lock plate 25. Since the other components are the same as those of the first actuator $\mathbf{45}_1$ components corresponding to those of the first actuator $\mathbf{45}_1$ in the drawing are denoted by the corresponding reference numerals with only the subscripts changed to "$_2$", and the detailed description thereof will be omitted.

Thus, the lock release position C of the lock plate 25 is defined by the pressure receiving pin $\mathbf{48}_2$ abutting on the inner end wall on the operation plunger $50_2$ side, of the long hole $47_2$. The lock position D of the lock plate 25 is defined by the pressure receiving pin $48_2$ abutting on the spring holding cylinder $53_2$ via the slider $49_2$ and the return plunger $51_2$.

If the operational strokes of the pressure receiving pins 48, and $48_2$ are defined by the inner end walls of the long holes $47_1$ and $47_2$, the operational strokes of the pressure receiving pins $48_1$ and $48_2$ can be defined with a high accuracy. If the operational strokes of the pressure receiving pin $48_1$ and $48_2$ are defined by causing the operation plungers $50_1$ and $50_2$ and the return plunger $51_1$ and $51_2$ to abut on the inner end walls of the cylinder holes $46_1$ and $46_2$, loads can be removed from the pressure receiving pins $48_2$ and $48_2$ at the operation limits of the pressure receiving pins $48_1$ and $48_2$.

Thus, the first and the second actuators $45_1$ and $45_2$ are constructed to be of substantially the same structures, and are disposed to sandwich the axial line of the piston inner part 5*a* below the lift member 28 and the lock plate 25 which are superposed from above and from below on the first holding plate 26. The components of the first and the second actuators $45_1$ and $45_2$, which correspond to each other, are compatible. Therefore, commonality of the components of the first and the second actuators $45_1$ and $45_2$ is achieved, thereby remarkably reducing the cost.

Figure 6:
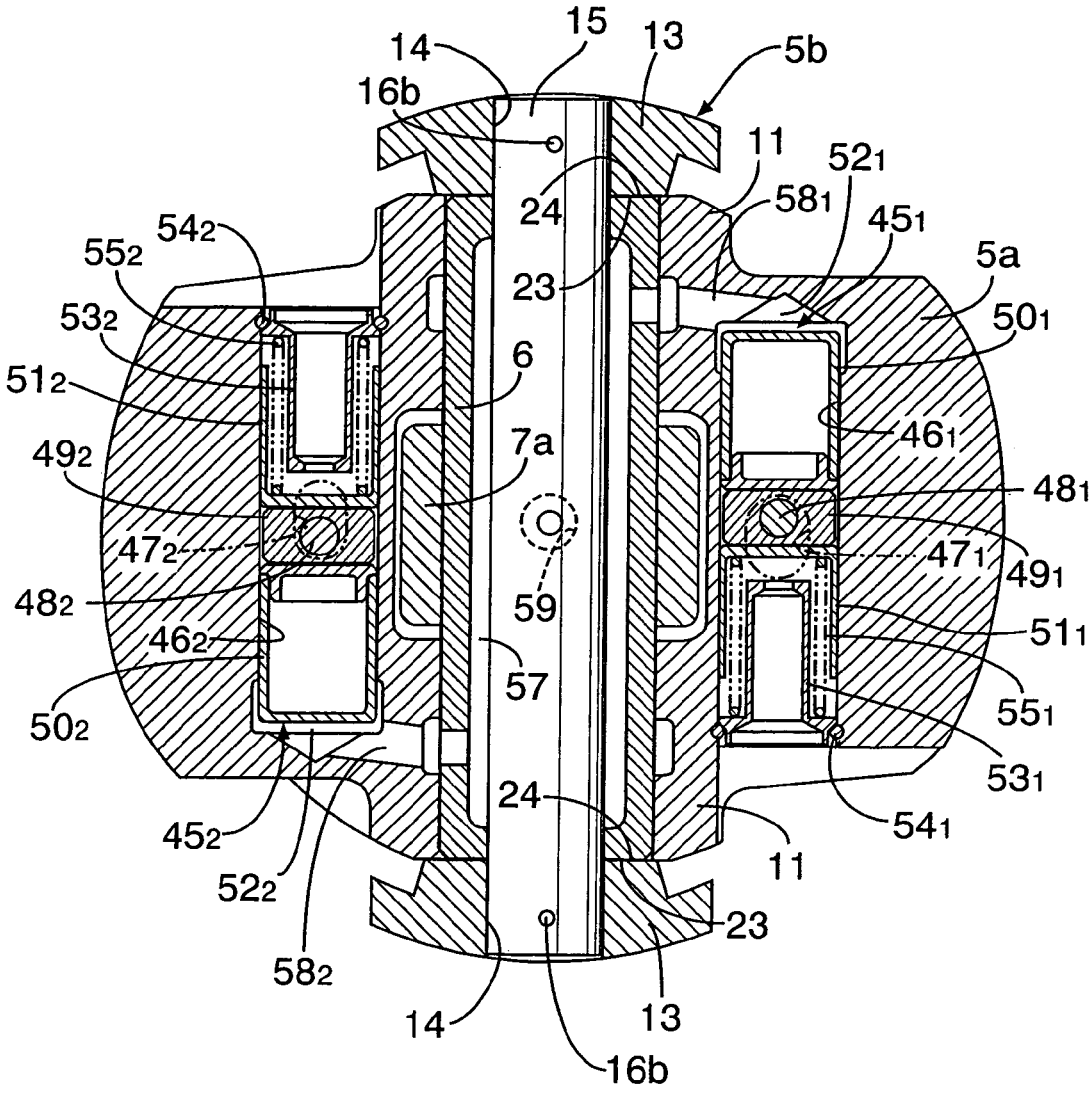
FIG. 6 is a sectional view taken on line 6-6 in FIG. 5.

As shown in FIG. 1 and FIG. 6, a cylindrical oil chamber 57 is defined between the piston pin 6 and the extension shaft 15 fitted into the hollow part of the piston pin 6, first and second distribution oil passages $58_1$ and $58_2$ which connect the oil chamber 57 to the hydraulic chambers $52_1$ and $52_2$ of the first and the second actuators $45_1$ and $45_2$ are provided in and across the piston pin 6 and the piston inner part 5*a*. The oil chamber 57 is connected to an oil passage 59 which is provided in and across the piston pin 6, the connecting rod 7 and the crankshaft 9. The oil passage 59 is switchably connected to an oil pump 61 serving as a hydraulic pressure source and an oil reservoir 62 through an electromagnetic type main switching valve 60. The oil reservoir 62 is an oil pan mounted to a bottom portion of the crankcase 3, and therefore a lubricating oil of the engine E is used as the operating oil of the first and the second actuators $45_1$ and $45_2$.

In FIG. 4, the extension shaft 15 has a hollow part 15*b* whose open surfaces at opposite ends are closed with end plates 15*a*. The hollow part 15*b* communicates with the cylindrical oil chamber 57 in the piston pin 6 through a through-hole 16*a* at a central portion of the extension shaft 15. The hollow part 15*b* also communicates with the long holes 14 of the ear parts 13 via jet holes 16*b* at opposite end portions of the extension shaft 15. In this case, the jet hole 16*b* at each of the end portions of the extension shaft 15 is preferably disposed to open toward the lower end surface of the corresponding long hole 14. In the example shown in the drawing, a plurality of jet holes 16*b* are arranged in the circumferential direction at the end portion of the extension shaft 15, so that even when the piston pin 6 rotates, at least one jet hole 16*b* is oriented to the lower end surface of the long hole 14.

Figure 15:
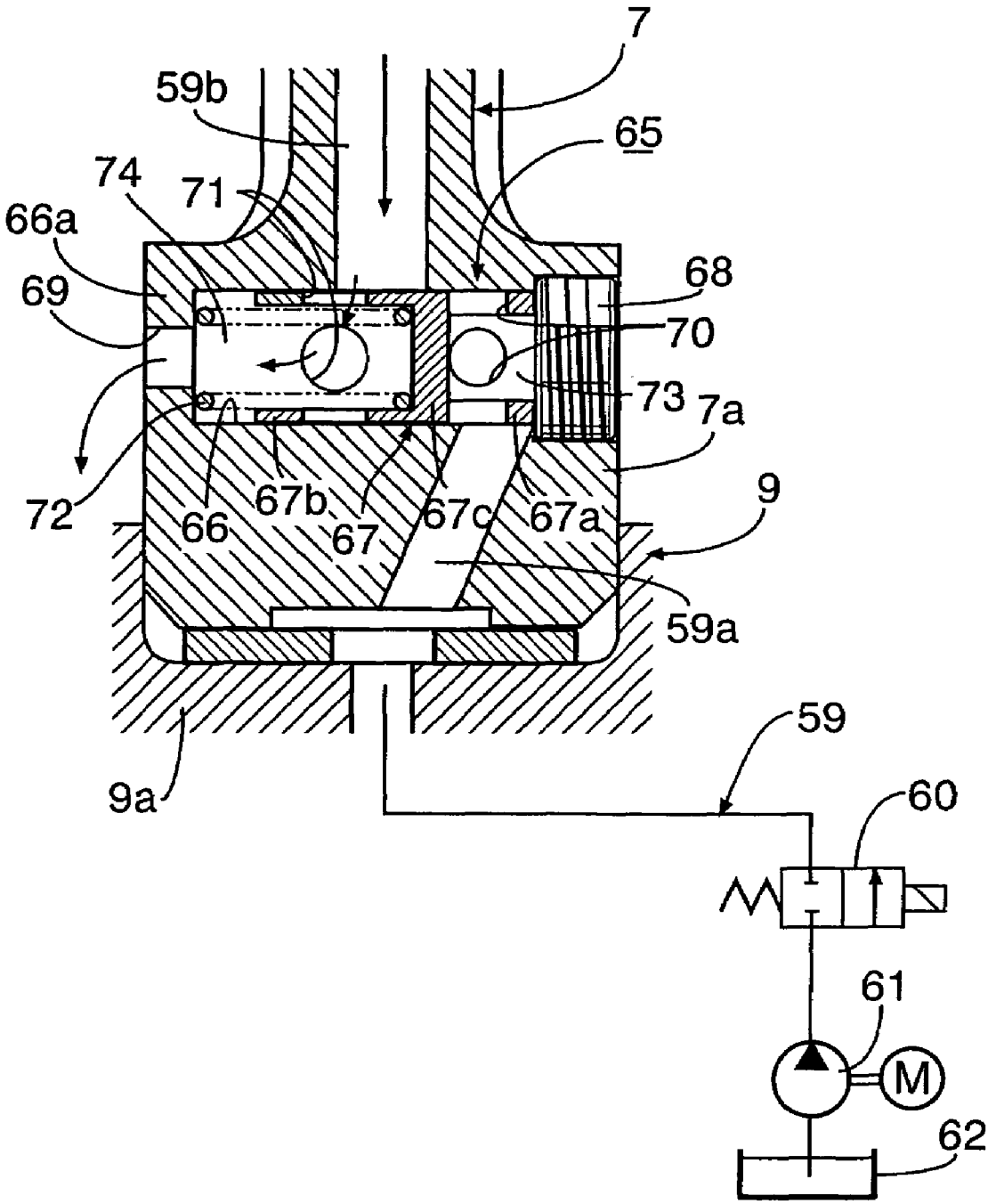
FIG. 15 is an enlarged view (low compression ratio state) of an auxiliary switching valve part in FIG. 1.
Figure 16:
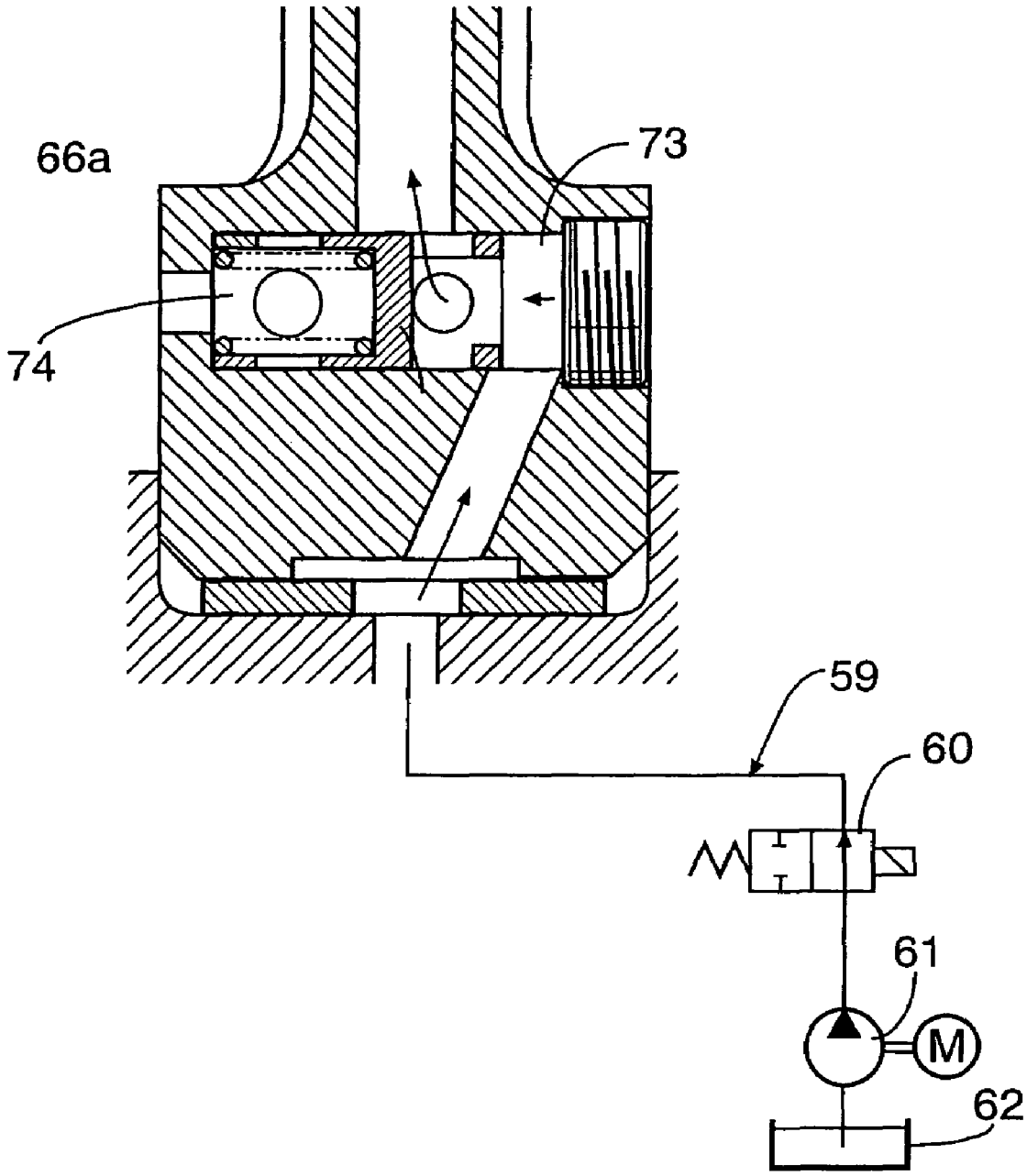
FIG. 16 is a view corresponding to FIG. 15, showing the high compression ratio state.

As shown in FIGS. 15 and 16, a hydraulic auxiliary switching valve 65 which moves the oil passage 59 in response to the discharge pressure of the oil pump 61 is provided in the large end portion 7*b* of the connecting rod 7. The auxiliary switching value 65 includes a valve chamber 66 which is formed in the large end portion 7*b* so as to divide the oil passage 59 into an upstream side oil passage 59*a* on the crank pin 9*a* side and a downstream side oil passage 59*b* on the piston pin 6 side and a piston-shaped valve body 67 slidably housed in the valve chamber 66. The valve chamber 66 and the valve body 67 are disposed so that the operating direction of the valve body 67 is parallel with the crank pin 9*a*. One end portion of the valve chamber 66 is closed with a thread plug 68, and a relief hole 69 which allows the valve chamber 66 to directly open into the crankcase 3 is provided in an end wall 66*a* on the side opposite from this one end portion. The valve body 67 is constructed by integrally connecting hollow cylindrical first and second valve parts 67*a* and 67*b* via a partition wall 67*c*. A plurality of inlet holes 70 are arranged in a peripheral wall of the first valve part 67*a* on the thread plug 68 side in the circumferential direction. A plurality of outlet holes 71 are arranged in a peripheral wall of the second valve part 67*b* in the circumferential direction. A valve spring 72 urging the valve body 67 toward the thread plug 68 with a predetermined set load is housed in the valve chamber 66. At this time, the valve spring 72 is disposed so that most of its part is housed in the hollow portion of the second valve part 67*b*, and its movable end portion is in contact under pressure with the partition wall 67*c*.

The valve body 67 moves between a retreat position where it abuts on the thread plug 68 and an advance position where it abuts on the end wall 66*a*. The valve chamber 66 is partitioned into a switching operation chamber 73 on the thread plug 68 side and a relief chamber 74 on the end wall 66*a* side by the partition wall 67*c* of the valve body 67. The upstream side oil passage 59*a* is connected to the switching operation chamber 73. The downstream side oil passage 59*b* is switched to communicate with the release chamber 74 via the outlet hole 71 in the retreat position of the valve body 67, and communicate with the switching operation chamber 73 via the inlet hole 70 in the advance position of the valve body 67.

In order to avoid interference of the lift member 28, the first holding plate 26 and the lock plate 25 with the outer slide flat surfaces 24 of the inner periphery of the piston outer part 5*b* at the time of insertion of the lift member 28, the first holding plate 26 and the lock plate 25 into the piston outer part 5*b*, a flat chamfer is provided to the outer peripheral surfaces of the lift member 28 and the first holding plate 26, and a part of the male spline 41 is cut out.

Next, an operation of the first embodiment will be described.

In FIGS. 3 to 8 and FIG. 13, the lift member 28 of the cam mechanism 37 is in the lift release position A and the lock plate 25 is engaged with the lock groove 43, so that the piston outer part 5*b* is held in the low compression ratio position L near the piston inner part 5*a*. Therefore, the compression ratio of the internal combustion engine E operated in this state is controlled to be relatively low.

Figure 9:
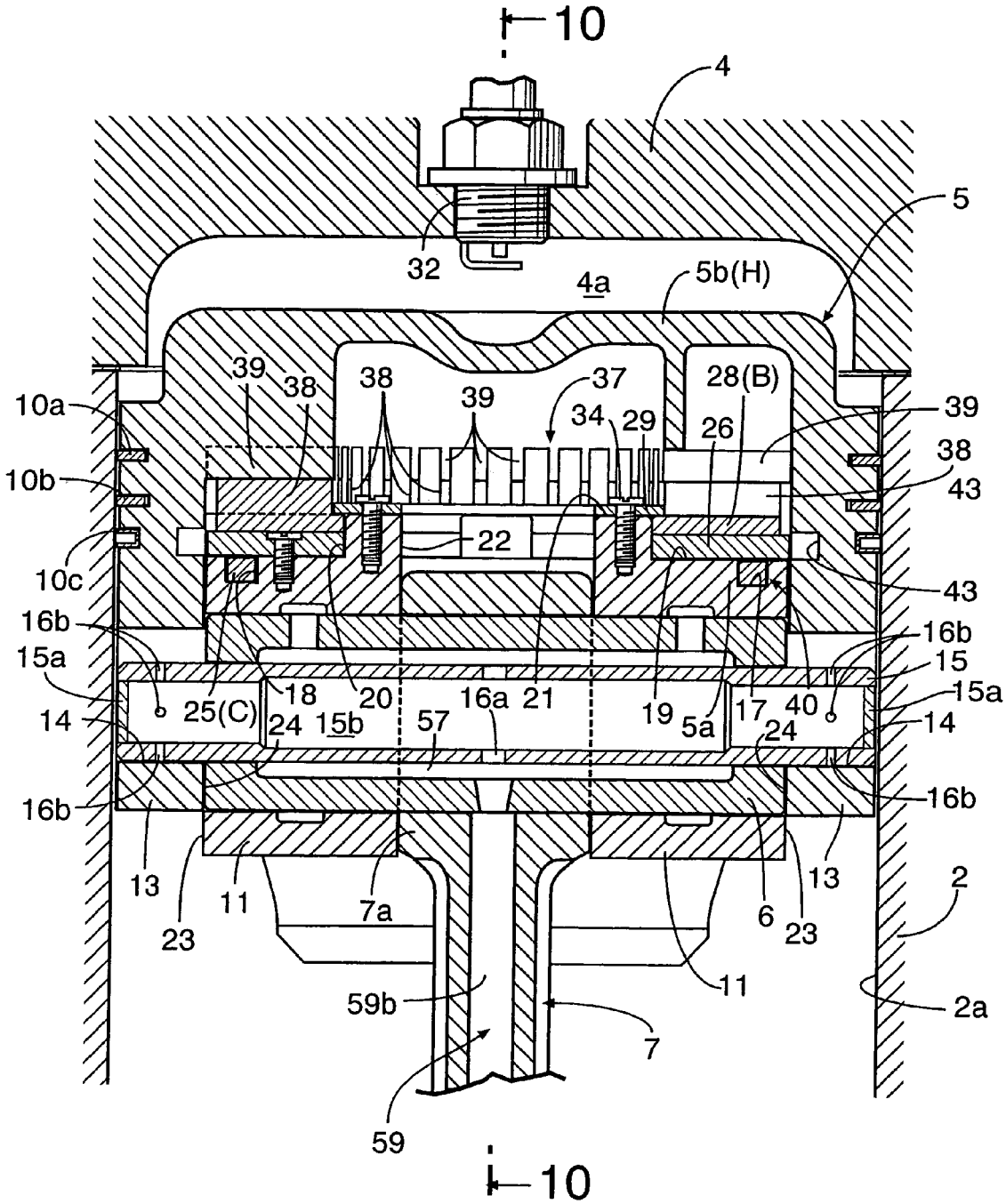
FIG. 9 is a view corresponding to FIG. 4, showing a high compression ratio state.

In order to shift from the above state to the high compression ratio state to increase output power, for example, at the time of high-speed operation of the internal combustion engine E, the main switching valve 60 is brought into an energizing state, that is, the ON state to connect the oil passage 59 to the oil pump 61. With this arrangement, the operating oil discharged by the oil pump 61 first flows into the switching operation chamber 73 of the auxiliary switching valve 65 through the upstream side oil passage 59*a*; pushes and moves the valve body 67 by its hydraulic pressure to the advance position against the set load of the valve spring 72 as shown in FIG. 15; and allows the inlet hole 70 of the valve body 67 to communicate with the downstream side oil passage 59*b*. As a result, the operating oil moves to the downstream side oil passage 59*b* through the inlet hole 70, and passes through the first and the second distribution oil passages $\mathbf{58}_1$ and $\mathbf{58}_2$ to be supplied to the hydraulic chambers $\mathbf{52}_1$ and $\mathbf{52}_2$ of the first and the second actuators $\mathbf{45}_1$ and $\mathbf{45}_2$ Then, as shown in FIG. 9, the operation plunger $\mathbf{50}_2$ of the second actuator $\mathbf{45}_2$ first receives the hydraulic pressure of the hydraulic chamber $\mathbf{52}_2$ and presses the pressure receiving pin $\mathbf{48}_2$ together with the slider $\mathbf{49}_2$ against the urging force of the return spring $\mathbf{55}_2$. Therefore, the pressure receiving pin $\mathbf{48}_2$ rotates the lock plate 25 from the lock position D to the lock release position C, thereby establishing a state of slidable fitting between the male spline 41 of the lock plate 25 and the female spline 42 of the piston outer part 5*b*.

Thus, the piston outer part 5*b* moves to the high compression ratio position H by a natural external force described below. When the piston outer part 5*b* is drawn toward the combustion chamber 4*a* by intake negative pressure in the intake stroke of the engine, when the piston outer part 5*b* is left behind by the piston inner 5*a* due to frictional resistance generated between the piston rings 10*a* to 10*c* and the inner surface of the cylinder bore 2*a* in the down-stroke of the piston 5, and when the piston outer part 5*b* is lifted from the piston inner part 5*a* due to its inertia force with the speed reduction of the piston inner part 5*a* at the second half of the up-stroke of the piston 5, the piston outer part 5*b* is displaced in the direction to be away from the piston inner part 5*a* toward the combustion chamber 4*a*. With this displacement, the extension shaft 15 supported by the piston inner part 5*a* relatively descends along the long holes 14 of the ear parts 13 of the piston outer part 5*b* to abut on the lower end walls of the long holes 14, thereby preventing the piston outer part 5*b* from being further displaced at the predetermined high compression ratio position H.

Therefore, the moving limit of the piston outer part 5*b* to the high compression ratio position side can be defined without using a special stopper member, thus contributing to simplification of the structure of the device. In addition, the impact upon stoppage of moving of the piston outer part 5*b* toward the high compression ratio position is directly transmitted from the piston outer part 5*b* to the piston pin 6 through the lower end walls of the long holes 14 and the extension shaft 15 which abut on each other, and is not transmitted to the piston inner part 5*a*. Thus, it is possible to prevent the impact from affecting the cam mechanism 37, the lock mechanism 40, the first and the second actuators $\mathbf{45}_1$ and $\mathbf{45}_2$, and the like which are provided at the piston inner part 5*a*, thereby securing their durability and operational stability.

When the piston outer part 5*b* comes to the high compression ratio position H, the first cam top portions 38 of the lift member 28 separate from the bottom portions between the second cam top portions 39 of the piston outer part 5*b*. Therefore, in the first actuator $\mathbf{45}_1$, the operation plunger $\mathbf{50}_1$ under the hydraulic pressure of the hydraulic chamber $\mathbf{52}_1$ presses and moves the pressure receiving pin $\mathbf{48}_1$ together with the slider $\mathbf{49}_1$ against the urging force of the return spring $\mathbf{55}_1$ to rotate the lift member 28 from the lift release position A to the lift position B. Accordingly, as shown in FIG. 14, the flat top surfaces of the first cam top portions 38 and the second cam top portions 39 abut on one another. Namely, the cam mechanism 37 is in the axially extended state.

Thus, the piston outer part 5*b* is held in the high compression ratio position H by the axially expanded state of the cam mechanism 37 and abutment between the extension shaft 15 and the lower end walls of the long holes 14. Accordingly, the piston inner part 5*a* and the piston outer part 5*b* integrally ascend and descend in the cylinder bore 2*a* while increasing the compression ratio, thereby contributing to enhancement in the output performance of the engine. Further, in the cam mechanism 37, the abutment surfaces of the top surfaces of the first and the second cam top portions 38 and 39 in an annular arrangement which are caused to abut on each other are distributed uniformly on the entire periphery of the piston 5 and the total area is large. Therefore, the cam mechanism 37 can sufficiently endure a high cylinder pressure in the expansion stroke and the compression stroke of the engine E.

When the main switching valve 60 is in the ON state where the oil passage 59 is connected to the oil pump 61, the operating oil which has ascended in the oil passage 59 is not only supplied to the first and the second actuators $\mathbf{45}_1$ and $\mathbf{45}_2$, but is also supplied into the long holes 14 of the ear parts 13 of the piston inner part 5*a* from the jet holes 16*b* and 16*b* sequentially through the oil chamber 57 in the piston pin 6, the through-hole 16*a* and the hollow part 15*b* of the extension shaft 15, so that the long holes 14 are filled with the operating oil. Therefore, the extension shaft 15 descends in the long holes 14 of the ear parts 13 with the movement of the piston outer part 5*b* from the low compression ratio position L to the high compression ratio position H, the lower half peripheral surface of the extension shaft 15 presses the operating oil in the long holes 14, the operating oil is pushed outside the long holes 14 though the gap around the ear parts 13 and the attenuating force generated at this time alleviates the abutting impact of the extension shaft 15 onto the lower end walls of the long holes 14. Thus, the piston outer part 5*b* can be reliably held at the high compression ratio position H, thereby improving durability of the ear parts 13 and the extension shaft 15.

It is preferable that the jet hole 16*b* provided in the extension shaft 15 is a single member oriented to the lower end wall of the corresponding long hole 14. With this arrangement, when the piston outer part 5*b* comes to the high compression ratio position H, the single jet hole 16*b* is closed by the lower end wall of the corresponding long hole 14 to suppress useless flowout of the operating oil from the jet hole 16*b*, thereby reducing capacity of the oil pump 61.

The loads in the separating directions acting on the piston outer part 5*b* and the piston inner part 5*a* in the intake stroke or the like can be reliably supported by the extension shaft 15 supported by the piston inner part 5*a* and the ear parts 13 of the piston outer part 5*b* having the long holes 14 in which the extension shaft 15 is fitted. The extension shaft 15 and the long holes 14 serves to prevent the relative rotation between the piston inner part 5*a* and the piston outer part 5*b*, thereby contributing to simplification of the structure. In addition, the piston outer part 5*b* has a sufficient strength by only thickening the ear parts 13 forming the long holes 14, thus contributing to reduction in weight of the piston outer part 5*b*, and further in weight of the piston 5.

Next, in order to switch the engine E from the high compression ratio state to the low compression ratio state, the main switching valve 60 is brought into the OFF state, that is, the non-energized state as shown in FIG. 15 to cause the oil passage 59 to open to the oil reservoir 62. Then, first with depressurization of the upstream side oil passage 59*a*, the switching operation chamber 73 of the auxiliary switching valve 65 is also depressurized, and therefore the valve body 67 immediately returns to the retreat position by the urging force of the valve spring 72, thereby allowing the outlet hole 71 to communicate with the downstream side oil passage 59*b*. As a result, the downstream side oil passage

59*b* is directly opened to the crank chamber 3*a* (see FIG. 1) through the outlet hole 71, the release chamber 74 and the release hole 69 of the auxiliary switching valve 65.

Thereafter, before and after the piston 5 passes through the bottom dead center, the operating oil in the downstream side oil passage 59*b* in the connecting rod 7 has a downward inertia force, and therefore it voluntarily escapes quickly from the release hole 69 of the auxiliary switching valve 65 into the crank chamber 3*a*. As a result, the hydraulic chambers $\mathbf{52}_1$ and $\mathbf{52}_2$ of the first and second actuators $\mathbf{45}_1$ and $\mathbf{45}_2$ which connect to the downstream side oil passage 59*b* are immediately depressurized, so that the pressure receiving pins $\mathbf{48}_1$ and $\mathbf{48}_2$ of the first and the second actuators $\mathbf{45}_1$ and $\mathbf{45}_2$ are respectively put under control of the return plungers $\mathbf{51}_1$ and $\mathbf{51}_2$ which receive the urging forces of the return springs $\mathbf{55}_1$ and $\mathbf{55}_2$.

The process after the main switching valve 60 is brought into the OFF state until the hydraulic chambers $\mathbf{52}_1$ and $\mathbf{52}_2$ of the first and the second actuators $\mathbf{45}_1$ and $\mathbf{45}_2$ are depressurized, will be described with reference to the diagrams in FIGS. 17 and 18.

Figure 17:
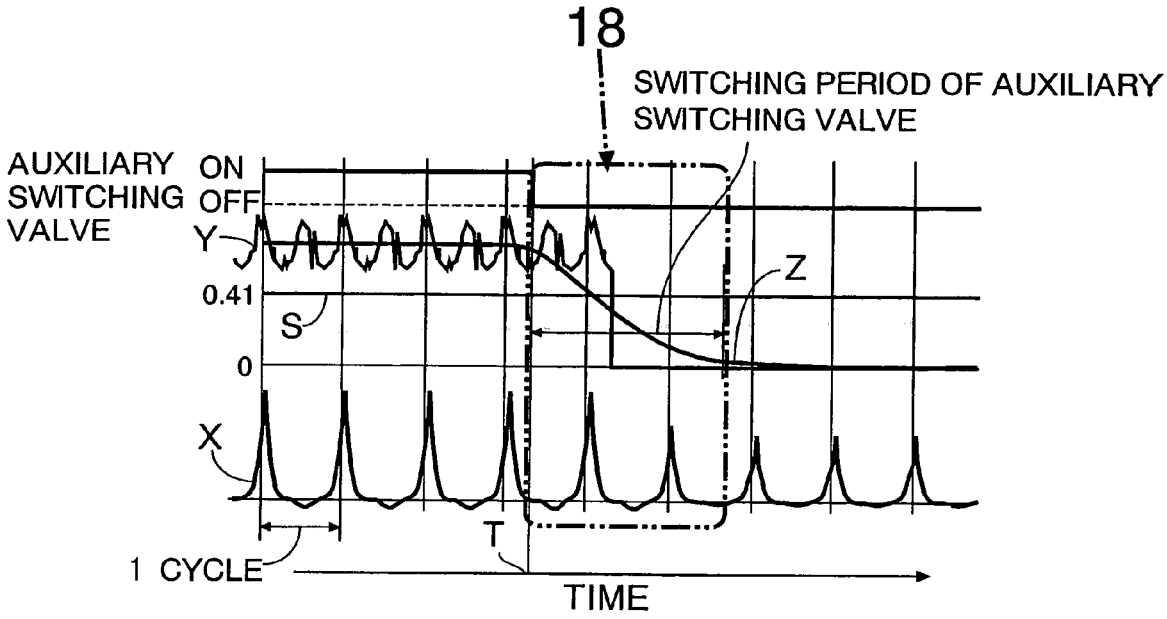
FIG. 17 is a diagram showing a hydraulic pressure change of the hydraulic actuator with the operation of the auxiliary switching valve.
Figure 18:
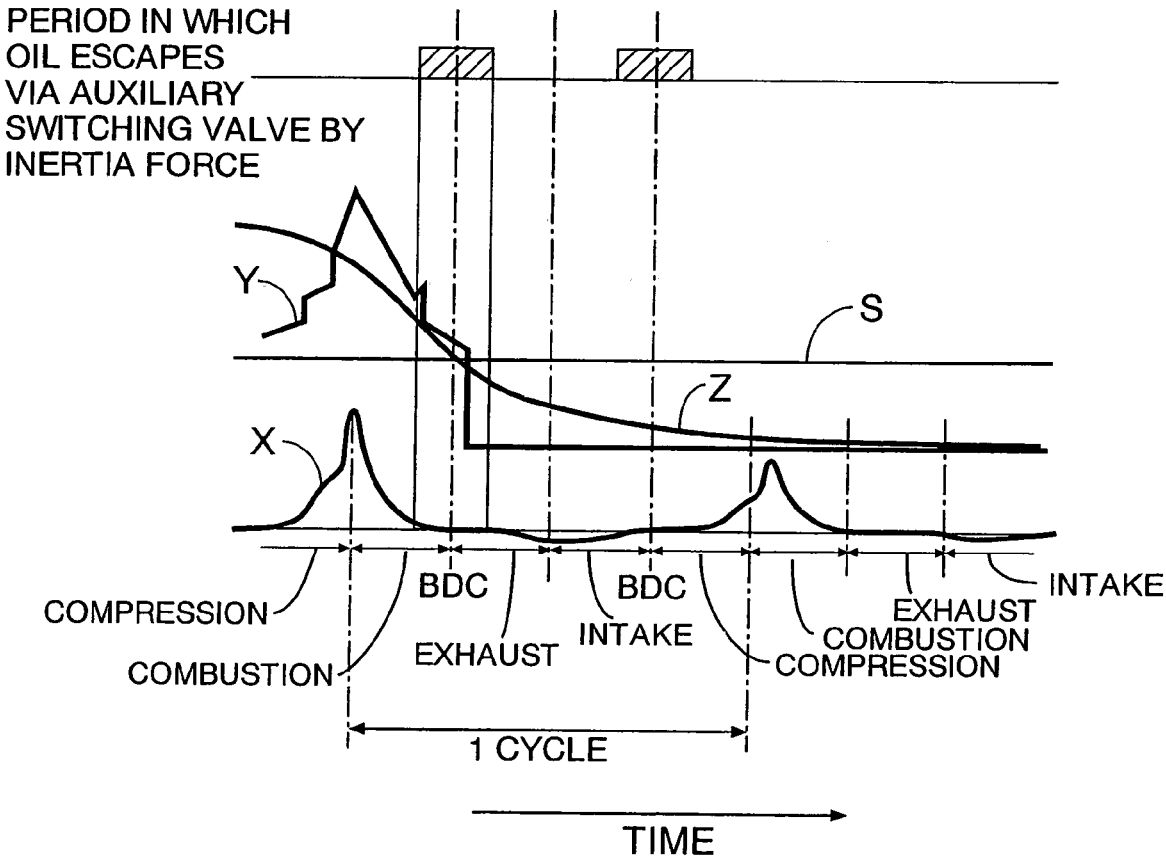
FIG. 18 is an enlarged view of part 18 in FIG. 17.

In FIGS. 17 and 18, a line X represents the pressure in the cylinder of the engine E, a line Y represents the pressure of the hydraulic chambers $\mathbf{52}_1$ and $\mathbf{52}_2$ of the first and the second actuators $\mathbf{45}_1$ and $\mathbf{45}_2$, and a line Z represents the discharge pressure of the oil pump 61 acting on the switching operation chamber 73 of the auxiliary switching valve 65. A line S represents the threshold value of the pressure acting on the hydraulic chambers $\mathbf{52}_1$ and $\mathbf{52}_2$. When the pressure becomes the threshold value S or higher, the first and the second actuators $\mathbf{45}_1$ and $\mathbf{45}_2$ are brought into the operating state. When the pressure becomes lower than the threshold value S, the first and the second actuators $\mathbf{45}_1$ and $\mathbf{45}_2$ are brought into the non-operating state.

The reason why the pressure of the hydraulic chambers $\mathbf{52}_1$ and $\mathbf{52}_2$ pulses in the ON state of the main switching valve 60, is that the direction of the inertia force of the operating oil of the hydraulic chambers $\mathbf{52}_1$ and $\mathbf{52}_2$ and the oil passage 59 changes with the reciprocal movement of the piston 5 and the connecting rod 7.

When the main switching valve 60 is brought into the OFF state at a time T and the auxiliary switching valve 65 is retreated, there are time periods, before and after the bottom dead center between the explosion stroke and the exhaust stroke of the engine E as well as before and after the bottom dead center between the intake stroke and the compression stroke of the engine E, where the operating oil of the downstream side oil passage 59*b* has a downward inertia force. Therefore, in either of the periods, the operating oil in the downstream side oil passage 59*b* is discharged from the release hole 69 of the auxiliary switching valve 65 into the crank chamber 3*a*, thereby quickly reducing the pressure of the hydraulic chambers $\mathbf{52}_1$ and $\mathbf{52}_2$ below the threshold value.

If such an auxiliary switching valve 65 is not available, the set loads of the return springs $\mathbf{55}_1$ and $\mathbf{55}_2$ are inevitably set to be large in the first and the second actuators $\mathbf{45}_1$ and $\mathbf{45}_2$. Therefore, with this setting, the operating oil pressure of the operation plungers $\mathbf{51}_1$ and $\mathbf{51}_2$, that is, the discharge pressure of the oil pump 61 needs to be increased, leading to an increased pressure of the oil pump 61, and also to an increased power consumption for driving the oil pump 61.

When the pressure of the hydraulic chambers $\mathbf{52}_1$ and $\mathbf{52}_2$ reduces below the threshold value in this way, first in the first actuator $\mathbf{45}_1$ the return plunger $\mathbf{51}_1$ presses and moves the pressure receiving pin $\mathbf{48}_1$ together with the slider $\mathbf{49}_1$ toward the hydraulic chamber $\mathbf{52}_1$ to rotate the lift member 28 to the lift release position A, so that the first cam top portions 38 and the second cam top portions 39 enter the position where their top parts are displaced from each other. Therefore, in the discharge stroke, the expansion stroke, the compression stroke and the like of the engine, when the piston outer part 5*b* is pressed against the piston inner part 5*a* by the pressure in the cylinder, when the piston outer part 5*b* is pressed against the piston inner part 5*a* by the frictional resistance generated between the piston rings 10*a* to 10*c* and the inner surface of the cylinder bore 2*a* in the up-stroke of the piston 5, and when the piston outer part 5*b* is pressed against the piston inner part 5*a* by its inertia force with speed reduction of the piston inner part 5*a* at the second half of the down-stroke of the piston 5, the piston outer part 5*b* is displaced to near the piston inner part 5*a* while the first cam top portions 38 and the second cam top portions 39 are meshed with one another, and the low compression ratio position L of the piston outer part 5*b* is determined by the top parts of the cam top portions 39 on one side abutting against the bottoms of the bottom portions between the cam top portions 38 on the other side.

When the piston outer part 5*b* reaches the low compression ratio position L, the male spline 41 of the lock plate 25 becomes capable of entering the lock groove 43 of the piston outer part 5*b*, and therefore the return plunger $\mathbf{51}_2$ of the second actuator $\mathbf{45}_2$ presses and moves the pressure receiving pin $\mathbf{48}_2$ together with the slider $\mathbf{49}_2$ toward the hydraulic chamber $\mathbf{52}_2$ by the urging force of the return spring $\mathbf{55}_2$, and rotates the lock plate 25 to the lock position D to bring the lock mechanism 40 into a lock state. More specifically, the male spline 41 of the lock plate 25 is caused to face the upper end surface of the female spline 42 of the piston outer part 5*b*, thereby inhibiting the sliding of both of the splines 41 and 42 with respect to each other.

The first holding plate 26 which suppresses rise of the lock plate 25 from the first support surface 17 of the piston inner part 5*a* is supported by the second support surface 19 of the piston inner part 5*a*, and therefore even when a thrust load acts on the first holding plate 26 from the cam mechanism 37 side, the load is received by the second support surface 19 and is inhibited from being transmitted to the lock plate 25. Therefore, the lock plate 25 can always rotate smoothly around the first pivotal shaft 18.

Thus, the piston outer part 5*b* is held in the low compression ratio position L by the axially contracted state of the cam mechanism 37 and the lock state of the lock mechanism 40. Even in this state, in the cam mechanism 37, the top parts of the cam top portions 39 on one of the first and second cam top portions 38 and 39 in the annular arrangement abut against the bottoms of the bottom portions between the cam top portions 38 on the other side, and therefore their abutting surfaces are uniformly distributed in the entire periphery of the piston 5, and the total area is large. Thus, the cam mechanism 37 can sufficiently endure the large pressure in the cylinder in the expansion stroke and the compression stroke of the engine E.

Further, the loads acting on the piston outer part 5*b* and the piston inner part 5*a* in the separating directions in the intake stroke or the like, acts on end surface abutting portions of the male spline 41 of the lock plate 25 and the female spline 42 of the piston outer part 5*b*. The end surface abutting portions are also uniformly distributed on the entire periphery of the piston 5, and the total area is large. Therefore, the lock mechanism 40 can sufficiently endure the loads in the separating directions.

As described above, the cam mechanism 37 is annularly placed between the piston inner part 5*a* and the piston outer part 5*b*, thereby allowing the piston inner part 5*a* and the piston outer part 5*b* to abut on each other in their entire peripheries via the cam mechanism 37. Therefore, heat transmission between the piston inner part 5*a* and the piston outer part 5*b*, especially heat transfer from the piston outer part 5*b* at a high temperature to the piston inner part 5*a* at a low temperature is smooth, thereby securing a favorable cooling performance of the piston 5. At the same time, transmission of a thrust force between the piston inner part 5*a* and the piston outer part 5*b* is efficient, thus contributing to enhancement in durability of the piston 5.

In addition, since the skirt parts 12 whose sliding is guided by the inner peripheral surface of the cylinder bore 2*a* of the engine E are integrally formed with the piston inner part 5*a*, and the peripheral wall of the piston outer part 5*b*, to which the piston rings 10*a* to 10*c* are fitted, is terminated directly above the skirt parts 12, the piston outer part 5*b* does not have the skirt parts. Therefore, even when the piston outer part 5*b* switches the position between the low compression ratio position L and the high compression ratio position H by using its inertia force, the piston outer part 5*b* can smoothly perform a switching to the above described positions without interference by the frictional resistance between the skirt parts 12 and the inner peripheral surface of the cylinder bore 2*a*.

Since the skirt parts 12 are formed in the piston inner part 5*a*, the overlapping portions of the piston inner part 5*a* and the piston outer part 5*b* greatly decrease, so that a significant weight reduction of the piston is achieved, thus contributing to an enhancement in output performance and durability of the engine E.

Further, the relative rotation between the piston inner part 5*a* and the piston outer part 5*b* can be reliably inhibited by the remarkably simple structure in which the extension shaft 15 projecting from opposite ends of the piston pin 6 is slidably fitted in the long holes 14 of the ear parts 13 of the piston outer part 5*b* which is disposed to be opposed to the piston pin 6 without interference by the skirt parts 12 of the piston inner part 5*a*.

The opening 22 which the small end portion 7*a* of the connecting rod 7 faces is provided in the central portion of the second pivotal shaft 20 of the piston inner part 5*a*, and the scattering lubricating oil generated in the crankcase 3, i.e., the crank chamber 3*a*, passes through the opening 22. Therefore, during operation of the engine E, the scattered lubricating oil is supplied to the cam mechanism 37 through the opening 22 to lubricate and cool the mechanism 37, thus contributing to an enhancement in reliability of the operation and durability. Further, since the lubricating oil of the engine E is used as the operating oil of the first and the second actuators $\mathbf{45}_1$ and $\mathbf{45}_2$, also the operating oil leaking from the actuators $\mathbf{45}_1$ and $\mathbf{45}_2$ further effectively performs lubrication of the cam mechanism 37.

Since the valve body 67 of the auxiliary switching valve 65 provided at the large end portion 7*b* of the connecting rod 7 performs rotational movement together with the large end portion 7*b*, it receives a simple centrifugal force. Therefore, during reciprocal movement of the piston 5, the valve body 67 receives a small impact, thus easily securing durability. In addition, during rotation of the large end portion 7*b*, the valve body 67 receives the centrifugal force in the direction perpendicular to its operating direction, thereby avoiding a malfunction due to the centrifugal force. This arrangement enables a low set load of the valve spring 72, and is effective in enhancing hydraulic responsiveness of the valve body 67.

Although the set load of the valve spring 72 for urging the valve body 67 in the retreat direction depends on the rise in pressure by the centrifugal force of the residual oil in the switching operation chamber 73, but it goes without saying that the set load needs to be capable of maintaining the valve body 67 in the retreat position.

As described above, the lock plate 25 and the lift member 28 are constructed to be of rotational types which are rotatably supported by the first and second pivotal shafts 18 and 20 integral with the piston inner part 5*a* with the first and the second actuators $\mathbf{45}_1$ and $\mathbf{45}_2$ which operate them being disposed with the axial line of the piston inner part 5*a* disposed therebetween, thereby reducing weight and size of the piston 5. Especially by the layout in which the first and the second actuators $\mathbf{45}_1$ and $\mathbf{45}_2$ are disposed below the lift member 28 and the lock plate 25 which are superposed on each other, thereby reasonably arranging the lift member 28 and the lock plate 25, and the first and the second actuators $\mathbf{45}_1$ and $\mathbf{45}_2$ in a concentrated manner, thereby further reducing the weight and size of the piston 5.

In addition, both the rotational type lift member 28 and lock plate 25 are given vibrations due to reciprocal movement of the piston and are supplied with lubricating oil, thereby reliably rotationally operating them by the single first and second actuators, respectively.

Figure 19:
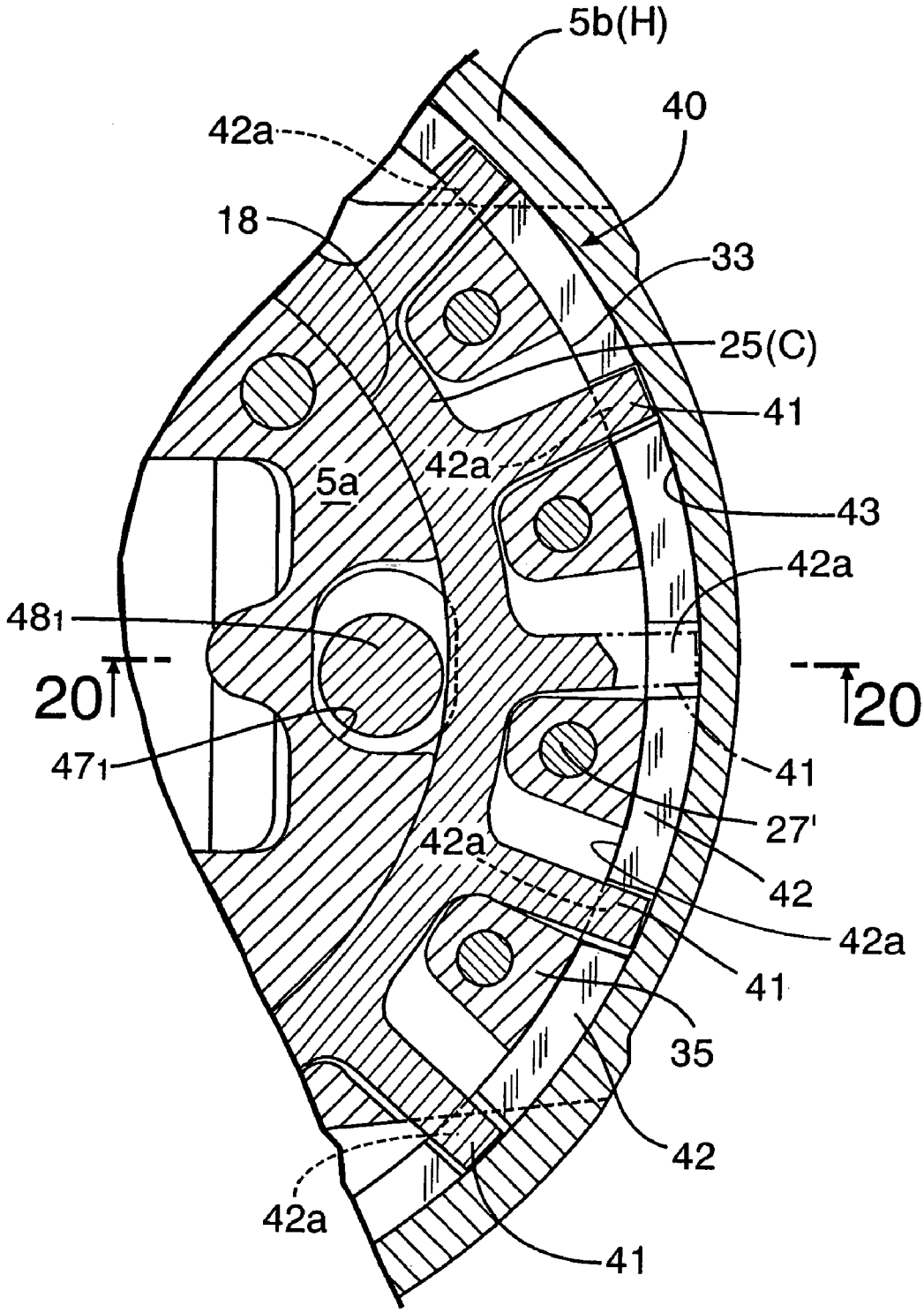
FIG. 19 is a view corresponding to FIG. 12, showing a second embodiment of the present invention.
Figure 20:
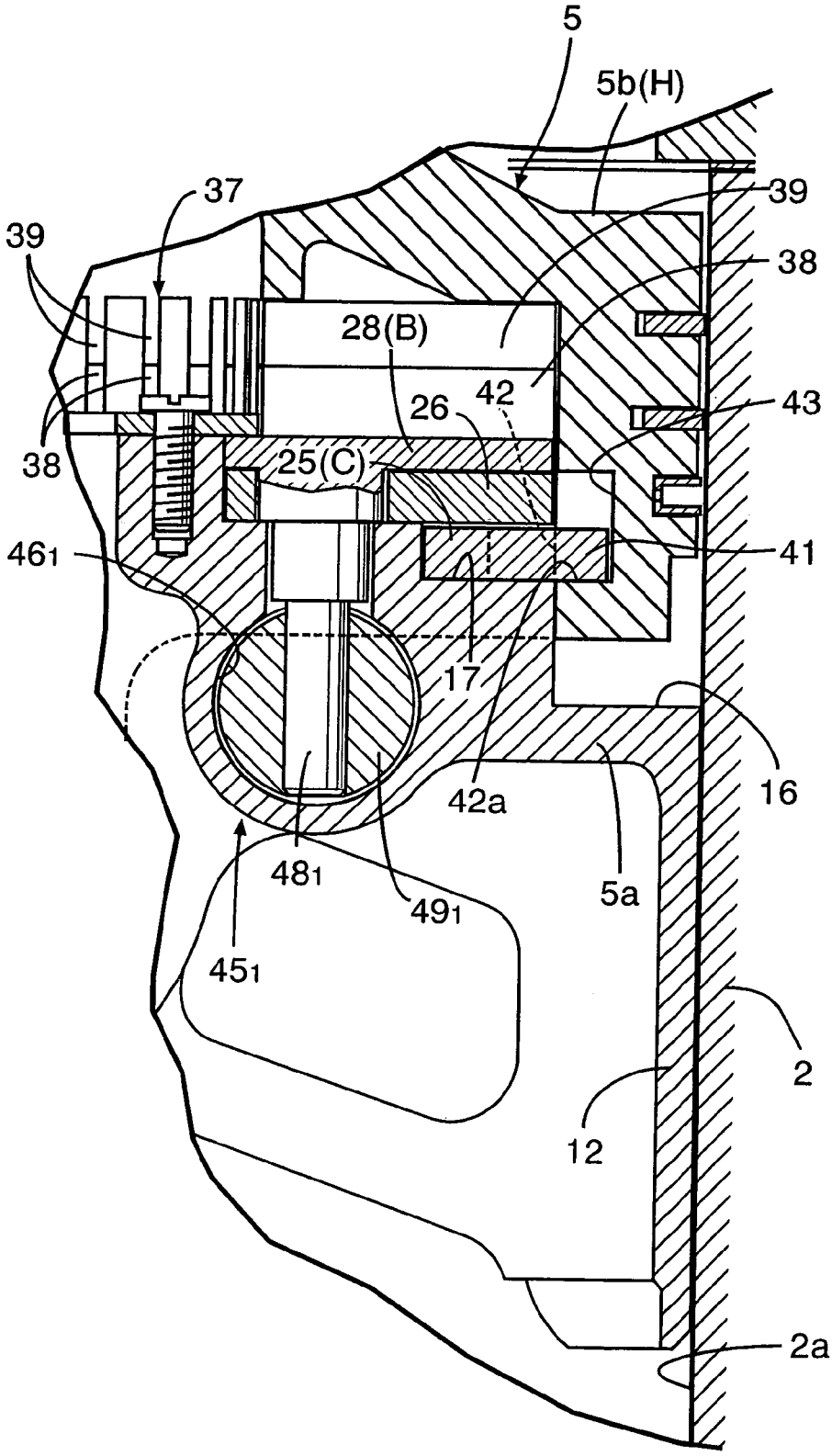
FIG. 20 is a sectional view taken on line 20-20 in FIG. 19.

Next, a second embodiment of the present invention will be described with reference to FIGS. 19 and 20.

In the second embodiment, closed portions 42*a* integral with the piston inner part 5*a* are provided in the groove portions of the female spline 42. The closed portions 42*a* receive the tooth portions of the male spline 41 to define the moving limit of the piston outer part 5*b* toward the high compression ratio position H. In this case, in order to secure a reliable abutment by the tooth portions of the male spline 41 onto the close portions 42*a* in the high compression ratio position H of the piston outer part 5*b*, the long holes 14 of the ear parts 13 in the piston outer part 5*b* are formed so that the extension shaft 15 which ascends and descends together with the piston pin 6 does not abut on the lower end walls. Since the other components are the same as those of the first embodiment, components corresponding to those of the first embodiment are denoted by the same reference numerals, and the overlapping description thereof will be omitted.

Thus, according to the second embodiment, the moving limit of the piston outer 5*b* toward the high compression ratio position H can be reliably defined by a remarkably simple structure in which the closed portions 42*a* are provided in the groove portions of the male spline 42.

The present invention is not limited to the above described embodiments, and various changes in design can be made to the present invention without departing from the subject matter thereof. For example, the auxiliary switching valve 65 can also be constructed as an electromagnetic type which is turned on and off simultaneously with the electromagnetic type main switching valve 60. In order to define the low compression ratio position L of the piston outer part 5*b*, the lower end surface of the piston outer part 5*b* can be caused to abut on the upper end surfaces 12*a* and 12*a* of the skirt parts 12 of the piston inner part 5*a*. Although the variable compression ratio device of the above described embodiments is of a low-compression-ratio oriented type so as to obtain a low compression ratio state at the non-operating time of the first and the second actuators $\mathbf{45}_1$ and $\mathbf{45}_2$, that is, at the time of retreat of the operation plungers $\mathbf{50}_1$ and $\mathbf{50}_2$ by the urging force of the return springs $\mathbf{55}_1$ and $\mathbf{55}_2$, the variable compression ratio device can be constructed to be of a high-compression-ratio oriented type so as to obtain a high compression ratio state at a non-operating time of the first and the second actuators $\mathbf{45}_1$ and $\mathbf{45}_2$.

Further, although the damping device of the above described embodiments for damping the abutting impact of the extension shaft 15 on the lower end walls of the long holes 14 is of a hydraulic type, the damping device can be constructed to be a mechanical type which elastically receives the extension shaft 15 with an elastic member buried in the lower end wall of the long hole 14, and the above described hydraulic type can be used in combination with this mechanical type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable compression ratio device of an internal combustion engine, comprising:

a piston including a piston inner part connected to a connecting rod via a piston pin, and a piston outer part which is fitted on an outer periphery of the piston inner part so as to be only slidable in an axial direction and which is movable between a low compression ratio position L near the piston inner part and a high compression ratio position H near a combustion chamber, with an outer end surface of the piston outer part facing the combustion chamber;

a cam mechanism provided between the piston inner part and the piston outer part, and alternately moving the piston outer part to the low compression ratio position L and the high compression ratio position H; and an actuator provided at the piston inner part for operating the cam mechanism;

the cam mechanism including a lift member supported by the piston inner part and moved by the actuator alternately to a lift release position A and a lift position B, a plurality of first cam top portions projectingly provided integrally on a top surface of the lift member and a plurality of second cam top portions projectingly provided on an undersurface of a head part of the piston outer part;

in the lift release position A of the lift member, the first cam top portions and the second cam top portions are meshed with each other to move the piston outer part to the low compression ratio position, and in the lift position B of the lift member, the first cam top portions and the second cam top portions cause their top surfaces to abut on each other to move the piston outer part to the high compression ratio position H;

wherein a skirt part is slidably guided by an inner peripheral surface of a cylinder bore of an engine B and is integrally formed at the piston inner part, and a peripheral wall of the piston outer part, to which piston rings are fitted, is terminated directly above the skirt part, wherein the piston outer part is engaged with the piston pin such that the piston outer part is slidable relative to the piston inner part alone an axis of the piston, while rotation of the piston outer part relative to the piston inner part around the axis of the piston is inhibited.

2. The variable compression ratio device of an internal combustion engine according to claim 1, wherein the lift member is formed into an annular shape to rotate between the lift release position A and the lift position B around a pivotal shaft which is formed coaxially integrally with the piston inner part; and the plurality of first cam top portions and second cam top portions are respectively disposed in annular shapes coaxially with the pivotal shaft.

3. The variable compression ratio device of an internal combustion engine according to claim 1, wherein the skirt part of the piston inner part is formed into a pair of arc-shapes except for portions corresponding to opposite ends of the piston pin, a pair of ear parts opposed to the opposite ends of the piston pin are integrally formed at the piston outer part and a shaft part linked to the opposite ends of the piston pin is slidably fitted in long holes which are formed in the ear parts and which have long diameters facing in an axial direction of the piston, thereby inhibiting relative rotation between the piston inner part and the piston outer part.

4. A variable compression ratio device of an internal combustion engine, comprising:

a piston including a piston inner part connected to a connecting rod via a piston pin, and a piston outer part which is fitted on an outer periphery of the piston inner part so as to be only slidable in an axial direction and which is movable between a low compression ratio position L near the piston inner part and a high compression ratio position H near a combustion chamber, with an outer end surface of the piston outer part facing the combustion chamber;

a cam mechanism provided between the piston inner part and the piston outer part, and alternately moving the piston outer part to the low compression ratio position L and the high compression ratio position H; and an actuator provided at the piston inner part for operating the cam mechanism;

the cam mechanism including a lift member supported by the piston inner part and moved by the actuator alternately to a lift release position A and a lift position B, a plurality of first cam top portions projectingly provided integrally on a top surface of the lift member and a plurality of second cam top portions projectingly provided on an undersurface of a head part of the piston outer part;

in the lift release position A of the lift member, the first cam top portions and the second cam top portions are meshed with each other to move the piston outer part to the low compression ratio position, and in the lift position B of the lift member, the first cam top portions and the second cam top portions cause their top surfaces to abut on each other to move the piston outer part to the high compression ratio position H;

wherein a skirt part is slidably guided by an inner peripheral surface of a cylinder bore of an engine E and is integrally formed at the piston inner part, and a peripheral wall of the piston outer part, to which piston rings are fitted, is terminated directly above the skirt part, wherein the skirt part of the piston inner part is formed into a pair of arc-shapes except for portions corresponding to opposite ends of the piston pin, a pair of ear parts opposed to the opposite ends of the piston pin are integrally formed at the piston outer part and a shaft part linked to the opposite ends of the piston pin is slidably fitted in long holes which are formed in the ear parts and which have long diameters facing in an axial direction of the piston, thereby inhibiting relative rotation between the piston inner part and the piston outer part.

5. The variable compression ratio device of an internal combustion engine according to claim 1, wherein an opening for introducing lubricating oil which is scattered in a crankcase into the cam mechanism is provided in a central portion of the piston inner part.

6. The variable compression ratio device of an internal combustion engine according to claim 2, wherein an opening for introducing lubricating oil which is scattered in a crankcase into the cam mechanism is provided in a central portion of the piston inner part.

7. The variable compression ratio device of an internal combustion engine according to claim 3, wherein an opening for introducing lubricating oil which is scattered in a crankcase into the cam mechanism is provided in a central portion of the piston inner part.

8. The variable compression ratio device of an internal combustion engine according to claim 5, wherein the actuator is a hydraulic type actuator using the lubricating oil of the engine E as operating oil and the cam mechanism is lubricated with the operating oil leaking from the actuator.

9. The variable compression ratio device of an internal combustion engine according to claim 6, wherein the actuator is a hydraulic type actuator using the lubricating oil of the engine E as operating oil and the cam mechanism is lubricated with the operating oil leaking from the actuator.

10. The variable compression ratio device of an internal combustion engine according to claim 7, wherein the actuator is a hydraulic type actuator using the lubricating oil of the engine E as operating oil and the cam mechanism is lubricated with the operating oil leaking from the actuator.

11. A variable compression ratio device adapted to be used with an internal combustion engine, comprising:

a piston including a piston inner part operatively connected to a connecting rod via a piston pin, and a piston outer part which is fitted on an outer periphery of the piston inner part so as to be only slidable in an axial direction and which is movable between a low compression ratio position L near the piston inner part and a high compression ratio position H near a combustion chamber, with an outer end surface of the piston outer part facing the combustion chamber;

a cam mechanism operatively connected between the piston inner part and the piston outer part for alternately moving the piston outer part to the low compression ratio position L and the high compression ratio position H; and an actuator operatively provided adjacent to the piston inner part for operating the cam mechanism;

the cam mechanism including a lift member supported by the piston inner part and moved by the actuator alternately to a lift release position A and a lift position B, a plurality of first cam top portions projectingly provided integrally on a top surface of the lift member and a plurality of second cam top portions projectingly provided on an undersurface of a head part of the piston outer part;

in the lift release position A of the lift member, the first cam top portions and the second cam top portions mesh with each other to move the piston outer part to the low compression ratio position, and in the lift position B of the lift member, the first cam top portions and the second cam top portions cause their top surfaces to abut on each other to move the piston outer part to the high compression ratio position H;

wherein a skirt part is slidably guided by an inner peripheral surface of a cylinder bore of an engine E that is integrally formed at the piston inner part, and a peripheral wall of the piston outer part, to which piston rings are fitted, is terminated directly above the skirt part, wherein the piston outer part is engaged with the piston pin such that the piston outer part is slidable relative to the piston inner part along an axis of the piston, while rotation of the piston outer part relative to the piston inner part around the axis of the piston is inhibited.

12. The variable compression ratio device adapted to be used with an internal combustion engine according to claim 11, wherein the lift member is formed into an annular shape to rotate between the lift release position A and the lift position B around a pivotal shaft which is formed coaxially integrally with the piston inner part; and the plurality of first cam top portions and second cam top portions are respectively disposed in annular shapes coaxially with the pivotal shaft.

13. The variable compression ratio device adapted to be used with an internal combustion engine according to claim 11, wherein the skirt part of the piston inner part is formed into a pair of arc-shapes except for portions corresponding to opposite ends of the piston pin, a pair of ear parts opposed to the opposite ends of the piston pin are integrally formed at the piston outer part and a shaft part linked to the opposite ends of the piston pin is slidably fitted in long holes which are formed in the ear parts and which have long diameters facing in an axial direction of the piston, thereby inhibiting relative rotation between the piston inner part and the piston outer part.

14. The variable compression ratio device adapted to be used with an internal combustion engine according to claim 12, wherein the skirt part of the piston inner part is formed into a pair of arc-shapes except for portions corresponding to opposite ends of the piston pin, a pair of ear parts opposed to the opposite ends of the piston pin are integrally formed at the piston outer part and a shaft part linked to the opposite ends of the piston pin is slidably fitted in long holes which are formed in the ear parts and which have long diameters facing in an axial direction of the piston, thereby inhibiting relative rotation between the piston inner part and the piston outer part.

15. The variable compression ratio device adapted to be used with an internal combustion engine according to claim 11, wherein an opening for introducing lubricating oil which is scattered in a crankcase into the cam mechanism is provided in a central portion of the piston inner part.

16. The variable compression ratio device adapted to be used with an internal combustion engine according to claim 12, wherein an opening for introducing lubricating oil which is scattered in a crankcase into the cam mechanism is provided in a central portion of the piston inner part.

17. The variable compression ratio device adapted to be used with an internal combustion engine according to claim 13, wherein an opening for introducing lubricating oil which is scattered in a crankcase into the cam mechanism is provided in a central portion of the piston inner part.

18. The variable compression ratio device adapted to be used with an internal combustion engine according to claim 15, wherein the actuator is a hydraulic type actuator using the lubricating oil of the engine E as operating oil and the cam mechanism is lubricated with the operating oil leaking from the actuator.

19. The variable compression ratio device adapted to be used with an internal combustion engine according to claim 16, wherein the actuator is a hydraulic type actuator using the lubricating oil of the engine B as operating oil and the cam mechanism is lubricated with the operating oil leaking from the actuator.

20. The variable compression ratio device adapted to be used with an internal combustion engine according to claim 17, wherein the actuator is a hydraulic type actuator using the lubricating oil of the engine E as operating oil and the cam mechanism is lubricated with the operating oil leaking from the actuator.

21. The variable compression ratio device of an internal combustion engine according to claim 1, wherein the skirt part is formed on the piston inner part except portions of the piston inner part corresponding to opposite ends of the piston pin, and the piston outer part is provided with a pair of extensions which extend downwardly to positions around said opposite ends of the piston pin, and wherein the extensions of the piston outer part and the opposite ends of the piston pin are operatively connected with each other so as to permit relative sliding between the piston inner part and piston outer part along the axis of the piston pin, and so as to inhibit relative rotation between the piston inner part and the piston outer part around the axis of the piston.

22. The variable compression ratio device of an internal combustion engine according to claim 11, wherein the skirt part is formed on the piston inner part except portions of the piston inner part corresponding to opposite ends of the piston pin, and the piston outer part is provided with a pair of extensions which extend downwardly to positions around said opposite ends of the piston pin, and wherein the extensions of the piston outer part and the opposite ends of the piston pin are operatively connected with each other so as to permit relative sliding between the piston inner part and piston outer part along the axis of the piston pin, and so as to inhibit relative rotation between the piston inner part and the piston outer part around the axis of the piston.

* * * * *